US009241873B2

(12) United States Patent
Upchurch et al.

(10) Patent No.: US 9,241,873 B2
(45) Date of Patent: Jan. 26, 2016

(54) MEDICINE CONTAINER, METHOD OF ASSEMBLING THE CONTAINER, AND METHOD OF DISPENSING THE MEDICINE FROM THE CONTAINER

(71) Applicant: AbbVie Inc., North Chicago, IL (US)

(72) Inventors: Guy Upchurch, North Chicago, IL (US); John G. Finch, North Chicago, IL (US)

(73) Assignee: AbbVie Inc., North Chicago, IL (US)

( * ) Notice: Subject to any disclaimer, the term of this patent is extended or adjusted under 35 U.S.C. 154(b) by 16 days.

(21) Appl. No.: 14/323,701

(22) Filed: Jul. 3, 2014

(65) Prior Publication Data

US 2015/0014203 A1 Jan. 15, 2015

Related U.S. Application Data

(63) Continuation of application No. 29/488,207, filed on Apr. 16, 2014, now Pat. No. Des. 731,783.

(60) Provisional application No. 61/842,841, filed on Jul. 3, 2013, provisional application No. 61/842,900, filed on Jul. 3, 2013.

(51) Int. Cl.
*B65D 83/04* (2006.01)
*A61J 1/03* (2006.01)
(Continued)

(52) U.S. Cl.
CPC ..... *A61J 1/035* (2013.01); *A61J 7/0076* (2013.01); *A61J 7/04* (2013.01); *B31B 11/00* (2013.01); *B31B 2201/88* (2013.01); *B31B 2203/103* (2013.01); *B65D 83/0463* (2013.01)

(58) Field of Classification Search
CPC ..... B65D 83/0463; A61J 1/035; A61J 7/04; A61J 7/0076; B21B 11/00; B21B 2201/88
USPC ..... 206/232, 459.5, 528, 530–532, 534, 206/538, 539, 562–564; 53/467, 468, 473, 53/476, 492; 229/125.125; 493/53, 84, 493/111, 114; 221/25, 28, 31
See application file for complete search history.

(56) References Cited

U.S. PATENT DOCUMENTS

D88,285 S 11/1932 Blenker
D189,489 S 12/1960 Jackson et al.
(Continued)

FOREIGN PATENT DOCUMENTS

AU 314244 S 5/2007
AU 341384 S 3/2012
(Continued)

OTHER PUBLICATIONS

Japanese Office action for Design Application No. 2014-7622 dated Apr. 22, 2014. (1 page).
(Continued)

*Primary Examiner* — Luan K Bui
(74) *Attorney, Agent, or Firm* — Julie A. Haut; Lisa V. Mueller; Michael Best & Friedrich LLP

(57) ABSTRACT

A child-resistant medication container assembly and method of dispensing the medication from the container assembly. The medication container assembly includes a blister pack with a plurality of compartments, each of which supports a medication. The container also includes a puck and a box. The blister pack compartments are aligned with openings on the puck, and the box is configured to receive and secure the puck and the blister pack such that each of the plurality of compartments is aligned with a complementary opening in the box.

20 Claims, 36 Drawing Sheets

(51) Int. Cl.

| | |
|---|---|
| ***A61J 7/00*** | (2006.01) |
| ***B31B 11/00*** | (2006.01) |
| ***A61J 7/04*** | (2006.01) |

(56) References Cited

U.S. PATENT DOCUMENTS

D201,899 S 8/1965 Hancock et al.
D205,676 S 9/1966 Kirwan
3,288,281 A 11/1966 Sparks
3,305,077 A 2/1967 Greif et al.
3,921,804 A * 11/1975 Tester ..... B65D 83/0463 206/531
RE29,705 E 7/1978 Compere
4,120,400 A 10/1978 Kotyuk
D254,219 S 2/1980 Papciak
4,192,422 A 3/1980 Kotyuk
D261,198 S 10/1981 Altadonna
D263,559 S 3/1982 Poore
D264,538 S 5/1982 Pomroy et al.
4,340,141 A 7/1982 Fischer
D266,147 S 9/1982 McIntosh et al.
D267,767 S 2/1983 Storrs
D268,130 S 3/1983 Easton
D276,116 S 10/1984 Basil et al.
D293,887 S 1/1988 Webster
4,838,444 A 6/1989 Bitel
5,050,739 A 9/1991 Hannan et al.
D320,930 S 10/1991 Richards
D322,400 S 12/1991 Sorensen
D322,934 S 1/1992 Kalvelage
5,109,984 A * 5/1992 Romick ..... B65D 83/0463 206/531
D327,363 S 6/1992 Farb
D331,258 S 11/1992 Tarozzi
D350,478 S 9/1994 Fuller et al.
D351,995 S 11/1994 Kalvelage
D351,996 S 11/1994 Kalvelage
5,489,025 A * 2/1996 Romick ..... A61J 7/0076 206/531
D370,414 S 6/1996 Lambelet, Jr.
D370,625 S 6/1996 Kelsey et al.
D372,124 S 7/1996 Dammers
D372,867 S 8/1996 Lambelet, Jr.
D382,474 S 8/1997 Malmborg
5,740,717 A 4/1998 Sowden et al.
D404,641 S 1/1999 Kelsey et al.
D411,445 S 6/1999 Anderson
D414,106 S 9/1999 Anderson
D414,409 S 9/1999 Sanfilippo et al.
6,082,544 A * 7/2000 Romick ..... B65D 83/0463 206/531
6,138,830 A 10/2000 Muggli
D434,558 S 12/2000 Brady et al.
6,273,260 B1 8/2001 Coldepietro et al.
D448,048 S 9/2001 Brown, III
D457,246 S 5/2002 Mazel et al.
6,443,307 B1 9/2002 Burridge
6,516,949 B2 2/2003 Fuller et al.
6,622,856 B2 9/2003 Gallo et al.
D480,958 S 10/2003 Mazel et al.
6,659,280 B2 12/2003 Paliotta et al.
6,679,382 B1 1/2004 Kancsar et al.
6,793,077 B1 9/2004 Kancsar et al.
6,896,139 B2 5/2005 Kancsar et al.
6,997,320 B1 2/2006 Kancsar et al.
D518,737 S 4/2006 Zalzal
7,063,211 B2 6/2006 Williams-Hartman
D525,777 S 8/2006 Priebe et al.
D526,478 S 8/2006 Priebe et al.
7,126,879 B2 10/2006 Snyder
7,188,728 B2 3/2007 Williams-Hartman
D546,198 S 7/2007 Currie et al.
D558,603 S 1/2008 Priebe et al.
7,360,652 B2 4/2008 Arnold
D574,665 S 8/2008 James
7,448,496 B2 11/2008 Williams-Hartman
D600,503 S 9/2009 Ragsdale et al.
7,641,050 B2 1/2010 Klatt et al.
7,665,610 B2 2/2010 Williams-Hartman
7,696,236 B2 4/2010 Bradford
D619,257 S 7/2010 Meschenmoser et al.
D620,260 S 7/2010 Emmert
7,748,535 B2 * 7/2010 Grosskopf ..... A61J 1/035 206/531
D622,158 S 8/2010 Proulx
7,767,700 B2 8/2010 Bradford
7,784,250 B2 8/2010 Grosskopf
7,900,772 B2 3/2011 Sack et al.
7,905,355 B2 3/2011 Williams-Hartman
7,926,660 B2 4/2011 Jones et al.
D637,391 S 5/2011 Stevens et al.
7,967,144 B2 6/2011 Sack et al.
D642,789 S 8/2011 Cooper
7,997,411 B2 8/2011 Williams-Hartman
D650,295 S 12/2011 Schmitz et al.
8,132,671 B2 3/2012 Hession
D658,991 S 5/2012 Schmitz et al.
D659,019 S 5/2012 Specker et al.
D659,550 S 5/2012 Mazor
8,205,752 B2 6/2012 Sack et al.
D663,981 S 7/2012 Purcell
D669,311 S 10/2012 Hsu
D670,178 S 11/2012 Carson
D673,297 S 12/2012 Hawker
8,342,330 B2 1/2013 Weston et al.
8,342,331 B2 1/2013 Ziemba et al.
8,403,212 B2 3/2013 van Esch
8,413,813 B2 4/2013 Grosskopf
8,420,674 B2 4/2013 Bradford
D683,950 S 6/2013 Ernster et al.
D684,482 S 6/2013 Stevens
D685,272 S 7/2013 Stevens
8,479,921 B2 7/2013 Ingraham
D688,570 S 8/2013 Logue
D688,571 S 8/2013 Logue
8,499,531 B2 8/2013 Benetti et al.
D689,373 S 9/2013 Logue
D689,374 S 9/2013 Logue
D689,778 S 9/2013 Logue
D691,465 S 10/2013 O'Brien et al.
D691,856 S 10/2013 Dabney-Wiggs
8,544,650 B2 10/2013 Williams-Hartman
8,550,248 B1 10/2013 Busen
8,556,077 B1 10/2013 Hanley
8,561,798 B2 10/2013 Hession
8,567,606 B2 10/2013 Bellamah et al.
8,573,403 B2 11/2013 Stevens et al.
8,579,106 B2 11/2013 Naik et al.
8,584,857 B2 11/2013 Ozawa et al.
D694,904 S 12/2013 Banes et al.
8,602,218 B2 12/2013 Grosskopf
8,607,982 B2 12/2013 Jones
8,607,983 B2 12/2013 Niven et al.
D697,095 S 1/2014 Chan
8,627,957 B2 1/2014 Ziemba et al.
8,640,917 B2 2/2014 Kracke
8,672,134 B2 3/2014 Sprada et al.
8,740,003 B2 6/2014 Elliott
8,746,454 B2 6/2014 Doucet et al.
8,752,704 B2 6/2014 Leon Alonso et al.
8,757,381 B2 * 6/2014 Bouthiette ..... B65D 1/34 206/528
D708,760 S 7/2014 Smeja
D708,761 S 7/2014 Smeja
D708,762 S 7/2014 Smeja
D711,219 S 8/2014 Palsson
D713,051 S 9/2014 Smeja
D723,279 S 3/2015 Wax
2003/0034271 A1 2/2003 Burridge
2003/0042167 A1 * 3/2003 Balz ..... B65D 83/0463 206/531
2003/0164380 A1 9/2003 Taneja et al.
2006/0163110 A1 * 7/2006 Adler ..... B65D 1/0223 206/534

(56) References Cited

U.S. PATENT DOCUMENTS

| | | | | |
|---|---|---|---|---|
| 2007/0185615 | A1 | 8/2007 | Bossi et al. | |
| 2009/0038982 | A1 | 2/2009 | Doucet et al. | |
| 2009/0242451 | A1 | 10/2009 | Kessler | |
| 2009/0301924 | A1* | 12/2009 | Rondeau | B65D 83/0463 206/531 |
| 2011/0215022 | A1 | 9/2011 | Sack et al. | |
| 2012/0248005 | A1 | 10/2012 | Bergey | |
| 2012/0261275 | A1* | 10/2012 | Intini | A61J 1/035 206/532 |
| 2013/0008825 | A1 | 1/2013 | McArthur et al. | |
| 2013/0193029 | A1 | 8/2013 | Weston et al. | |
| 2013/0220870 | A1 | 8/2013 | Grosskopf | |
| 2013/0220871 | A1 | 8/2013 | Bradford | |
| 2013/0233756 | A1 | 9/2013 | Weston et al. | |
| 2013/0256183 | A1 | 10/2013 | Ingraham | |
| 2013/0281960 | A1 | 10/2013 | Hanley | |
| 2013/0306511 | A1 | 11/2013 | Branyon et al. | |
| 2014/0001194 | A1 | 1/2014 | Pipes et al. | |
| 2014/0027340 | A1 | 1/2014 | Hession | |
| 2014/0027341 | A1 | 1/2014 | Ludwig et al. | |
| 2014/0083900 | A1 | 3/2014 | Ziemba et al. | |
| 2014/0171436 | A1 | 6/2014 | Kamen et al. | |
| 2014/0183095 | A1 | 7/2014 | Choubey et al. | |
| 2014/0209498 | A1 | 7/2014 | Stevens | |
| 2014/0214438 | A1 | 7/2014 | Ahmadi | |
| 2014/0216968 | A1 | 8/2014 | Wagner et al. | |
| 2014/0216977 | A1 | 8/2014 | Bowers et al. | |

FOREIGN PATENT DOCUMENTS

| | | | |
|---|---|---|---|
| AU | 346153 | S | 1/2013 |
| AU | 348282 | S | 5/2013 |
| AU | 357121 | S | 8/2014 |
| AU | 359486 | S | 12/2014 |
| CA | 114356 | | 3/2008 |
| CA | 120646 | | 3/2014 |
| CL | 36012012 | | 12/2012 |
| CL | 8902013 | | 4/2013 |
| CL | 8912013 | | 4/2013 |
| EP | 1211191 | | 5/2002 |
| EP | 1481914 | A1 | 12/2004 |
| WO | 2005120984 | | 12/2005 |
| WO | 2010015638 | | 2/2010 |
| WO | 2014057967 | | 4/2014 |
| WO | 2014085625 | | 6/2014 |

OTHER PUBLICATIONS

Japanese Office action for Design Application No. 2014-7623 dated Apr. 22, 2014. (1 page).
International Search Report and Written Opinion for Application No. PCT/US2014/045459, mailed on Nov. 3, 2014, 18 pages.
U.S. Appl. No. 29/424,276, filed Jun. 10, 2012, Akana et al.
Chilean Patent Office Action for Application No. 2014-000864 dated Sep. 21, 2015 (8 pages).
Chilean Patent Office Action for Application No. 2014-000866 dated Sep. 21, 2015 (8 pages).
Chilean Patent Office Action for Application No. 2014-002839 dated Sep. 28, 2015 (6 pages).

* cited by examiner

MEDICINE CONTAINER, METHOD OF ASSEMBLING THE CONTAINER, AND METHOD OF DISPENSING THE MEDICINE FROM THE CONTAINER

CROSS-REFERENCE TO RELATED APPLICATIONS

This application is a non-provisional of and claims the benefit of U.S. Provisional Patent Application No. 61/842,841, filed on Jul. 3, 2013, and U.S. Provisional Patent Application No. 61/842,900, filed on Jul. 3, 2013. This application also is a continuation of U.S. Patent Application No. 29/488,207, filed on Apr. 16, 2014, Pat. No. D731783. The entire contents of each application are fully incorporated herein by reference.

BACKGROUND OF THE INVENTION

Prescription medicines require a prescription prepared by a person authorized to prescribe medicine. A prescription medicine is dispensed by a pharmacist, and the prescription medicine typically comes with an information leaflet providing information about the medicine, its side effects, if any, instructions for use of the medicine, and any relevant cautions and warnings.

Most prescription medicines are dispensed by a pharmacist in a bottle or in a blister pack. Some prescription medicines that are dispensed in this manner have complicated instructions for use and may not be easy for a patient to remember. For example, some prescription medicines are to be taken in the morning, afternoon, or evening, some with or without food, some with or without certain types of food, and particular quantities. In these situations, a patient may need to read the bottle or refer back to the information leaflet for instructions when taking the medicine. A patient also may need to keep a log of when he or she took the medicine to ensure compliance with any timing instructions.

SUMMARY OF THE INVENTION

The present invention relates to a system and a container for securing and dispensing medicine that provides instructions for use that are visible upon access to and administration of the medicine. In particular, the invention relates to a container, which secures medicine and is child-resistant thereby preventing children from accessing the medicine enclosed within the container. The invention also relates to a method for assembling the child-resistant container. The invention also relates to a method for accessing or dispensing, by an intended user, the medicine secured within the child-resistant container.

Medication packaging is regulated by the government in an effort to ensure that the packaging is substantially child-resistant. Each medication package is constructed to meet specific criteria that are based on the contents within the package and the type and potency of the medication.

In one embodiment, the invention provides a child-resistant medication container assembly. The assembly comprises a blister pack including a plurality of compartments, each of the plurality of compartments configured to support at least one medication; a puck including a recess having a plurality of openings with each opening in the puck corresponding to one of the plurality of compartments of the blister pack; and a box including a first wall opposite a second wall, a plurality of openings extending through the first wall, each of the openings in the first wall being aligned with corresponding perforations in the second wall, each of the openings in the first wall being aligned with one of the openings in the puck and a corresponding compartment of the blister pack.

In another embodiment the invention provides a method of assembling a child-resistant medication container. The method comprises aligning a blister pack including a plurality of compartments with a puck including a recess and a plurality of openings, each of the plurality of openings configured to be complementary to one of the plurality of compartments; attaching the blister pack to the puck; inserting the blister pack and the puck into a box, the box including a first wall opposite a second wall, a plurality of openings extending through the first wall and being aligned with a plurality of perforations in the second wall, each of the aligned plurality of openings and perforations being complementary to one of the plurality of compartments; and closing the box to enclose the blister pack and the puck.

In another embodiment the invention provides a method of dispensing medication secured within a child-resistant medication container to a user. The method comprises providing a container including a box, a puck, and a blister pack, the puck being secured to the box, and the blister pack being secured to the puck; applying a force to at least one compartment of a plurality of compartments of the blister pack, each of the plurality of compartments being aligned with a complementary one of a plurality of openings in a first wall of the box; breaking a seal of the at least one compartment to move medication contained within the at least one compartment; expelling the medication through an opening in the recess of the puck, the opening being complementary to the at least one compartment; and expelling the medication through a perforation in a second wall of the box, the perforation being complementary to the at least one compartment.

Other aspects of the invention will become apparent by consideration of the detailed description and accompanying drawings.

DETAILED DESCRIPTION

Figure 1:
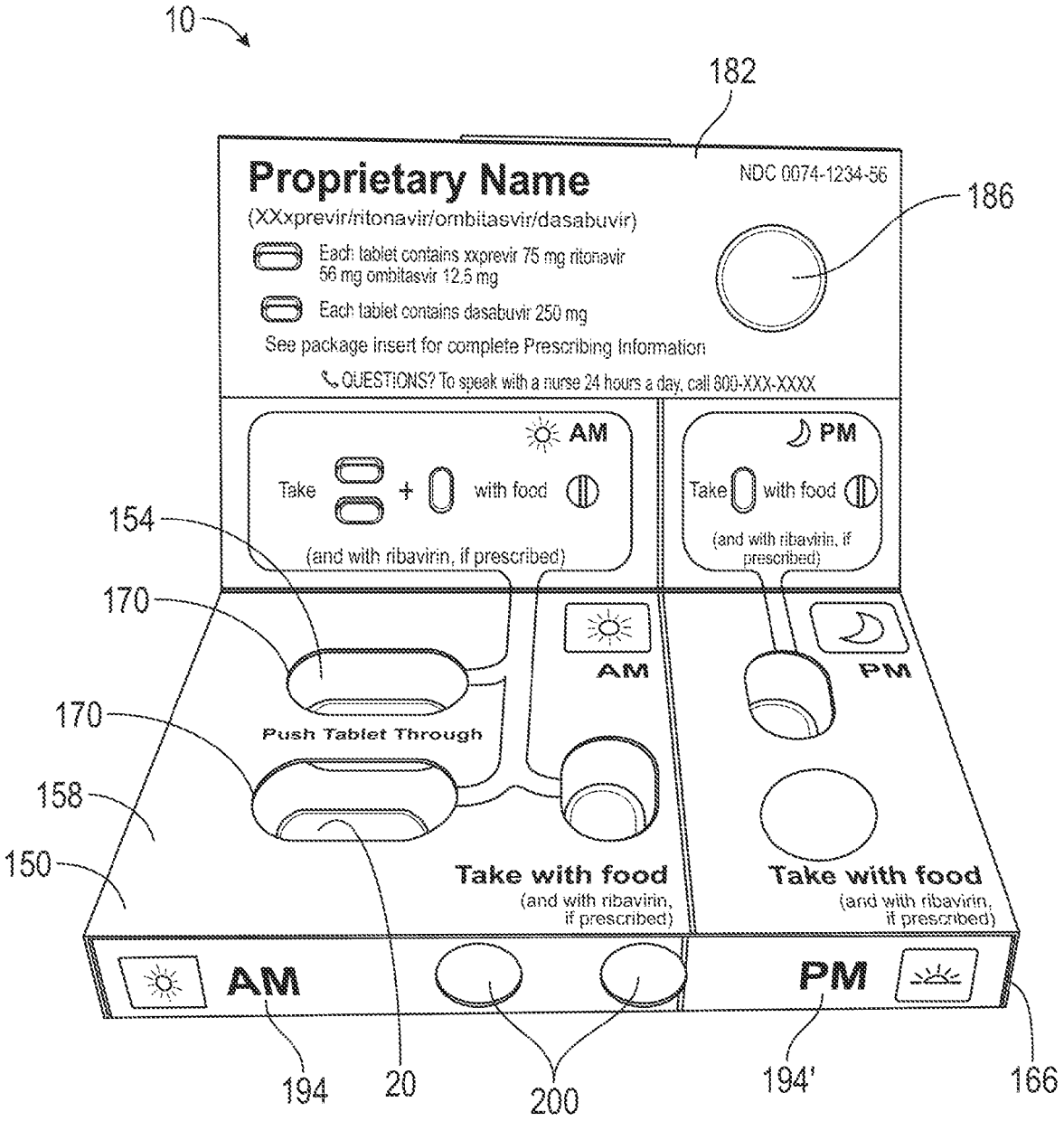
FIG. 1 is a front perspective view of a medicine container assembly according to one embodiment of the invention.
Figure 2A:
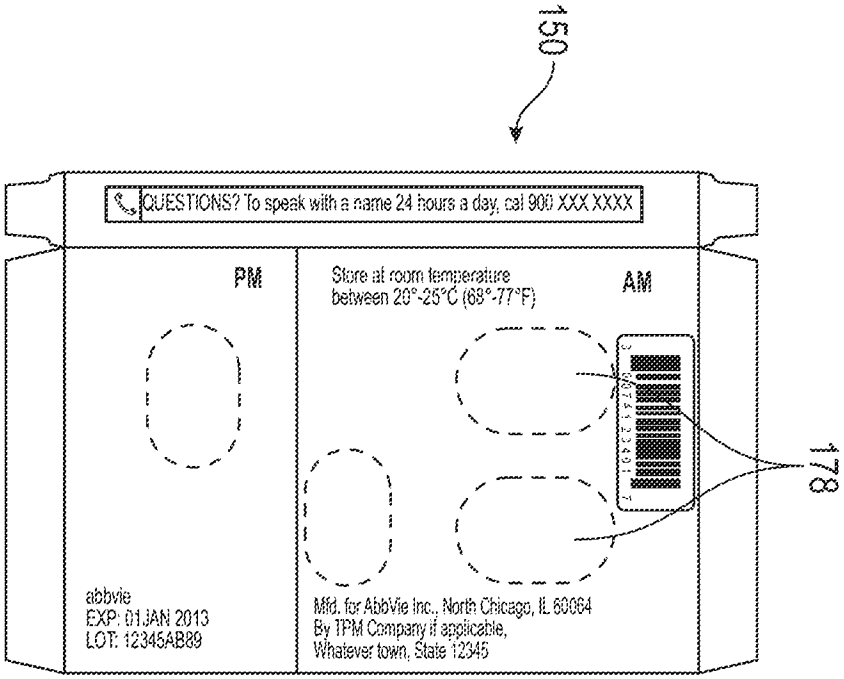
FIG. 2A illustrates a box of the medicine container illustrated in FIG. 1.
Figure 2B:
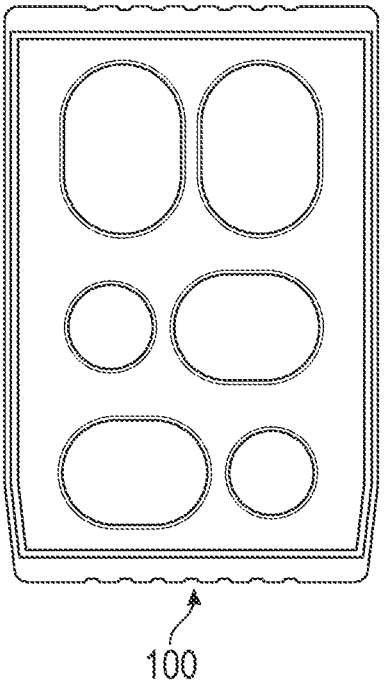
FIG. 2B illustrates a puck or a template of the medicine container illustrated in FIG. 1.
Figure 2C:
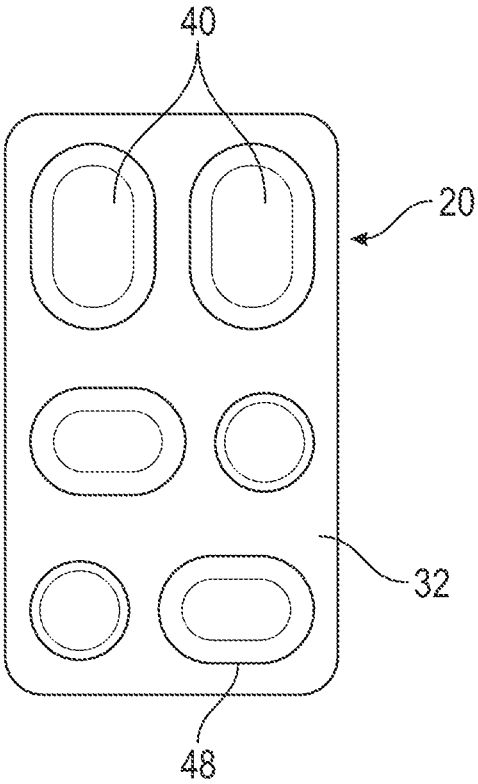
FIG. 2C illustrates a blister pack of the medicine container illustrated in FIG. 1.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

FIGS. 1 and 2A-C illustrate a container assembly or package 10 for medication according to a first embodiment of the invention. The medication may be acquired by prescription or available over-the-counter. The container assembly 10 includes a blister pack 20, a puck 100, and a box 150.

Figure 5:
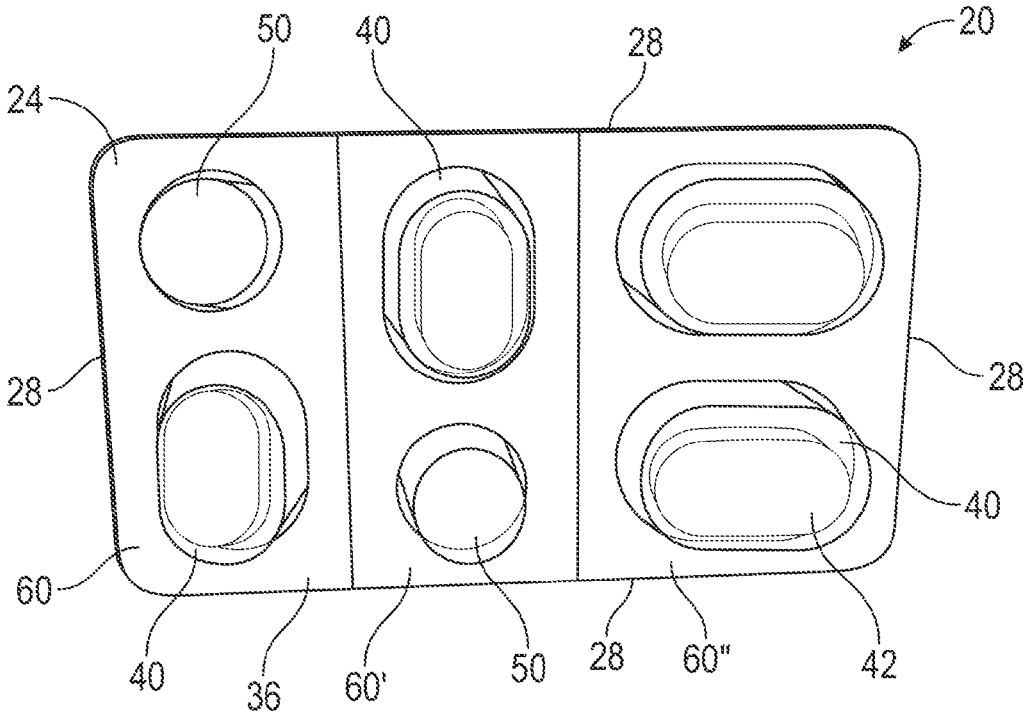
FIG. 5 is a front perspective view of an exemplary blister pack.
Figure 7:
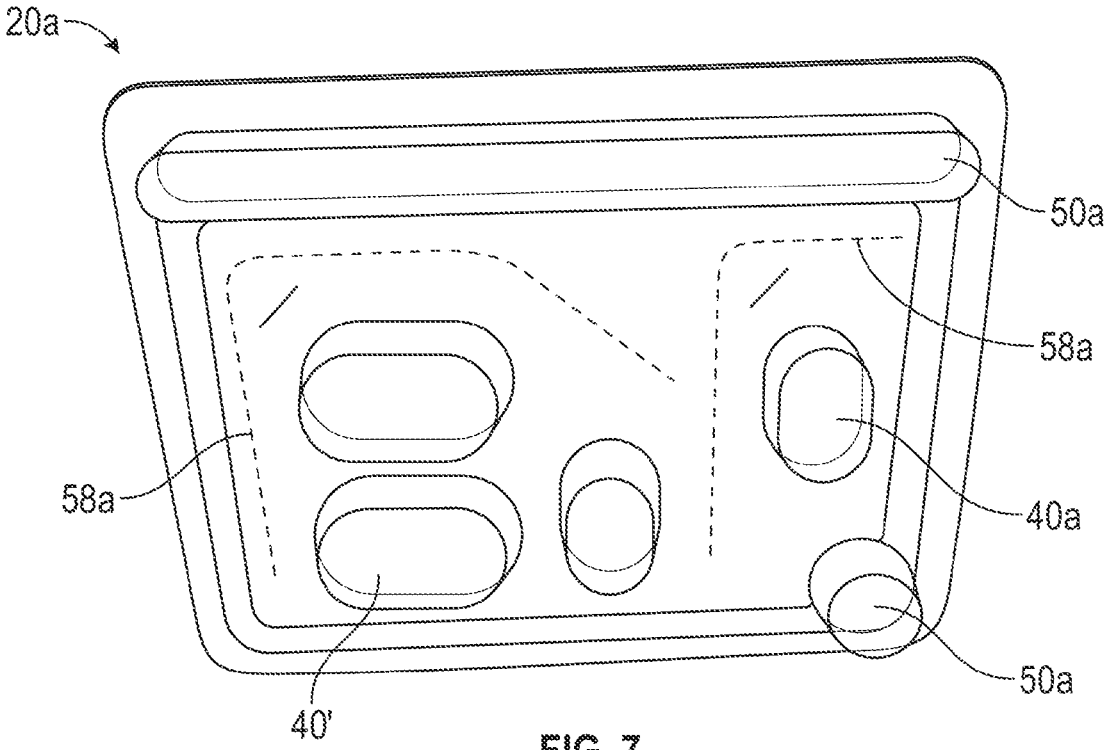
FIGS. 7 and 8 are front perspective views of a blister pack having another configuration.
Figure 6:
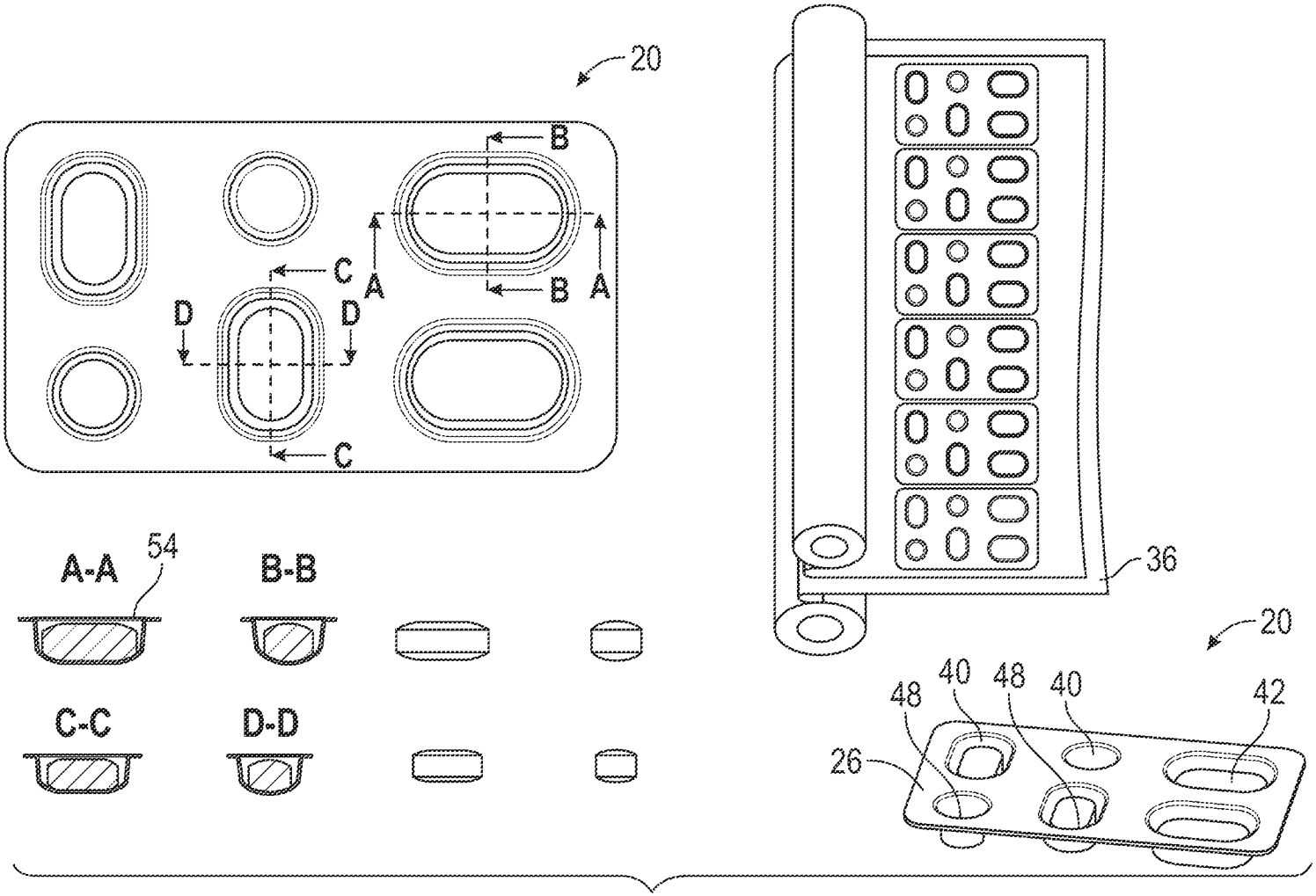
FIG. 6 illustrates engineering drawing specifications of the exemplary blister pack of FIG. 5.
Figure 8:
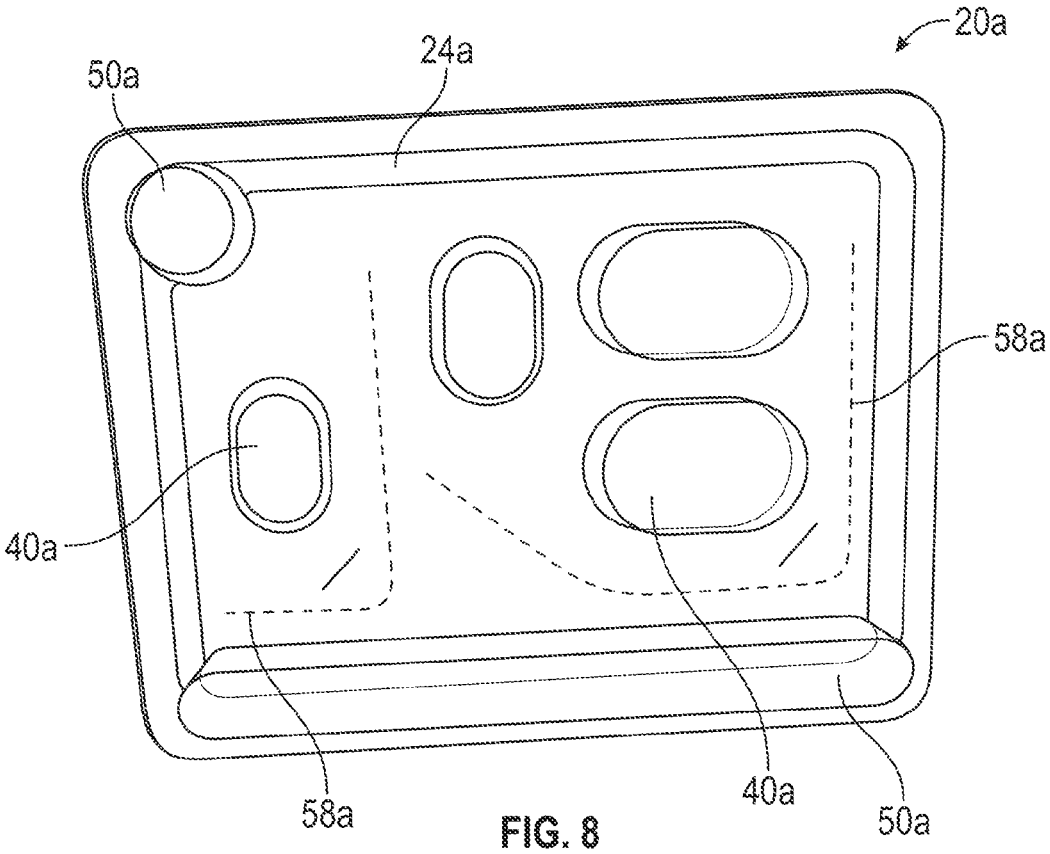
Figure 9:
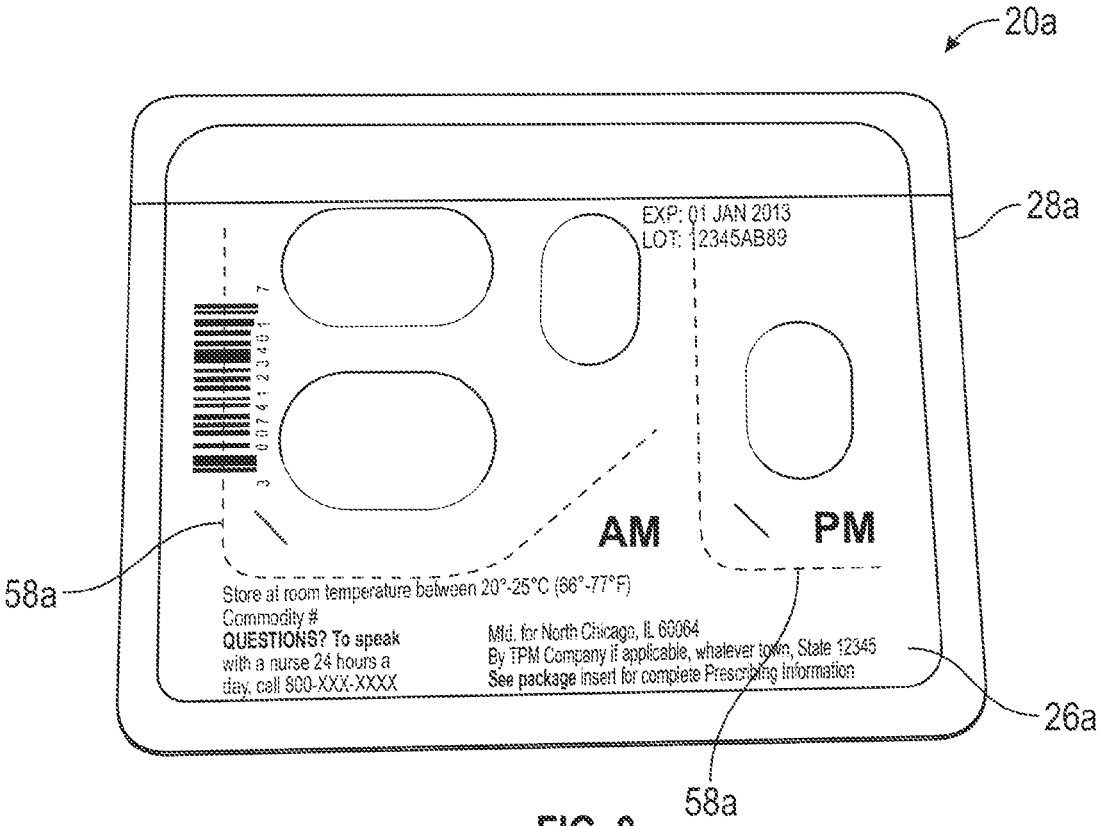
FIG. 9 is a bottom perspective view of the blister packs illustrated in FIGS. 7 and 8.
Figure 10:
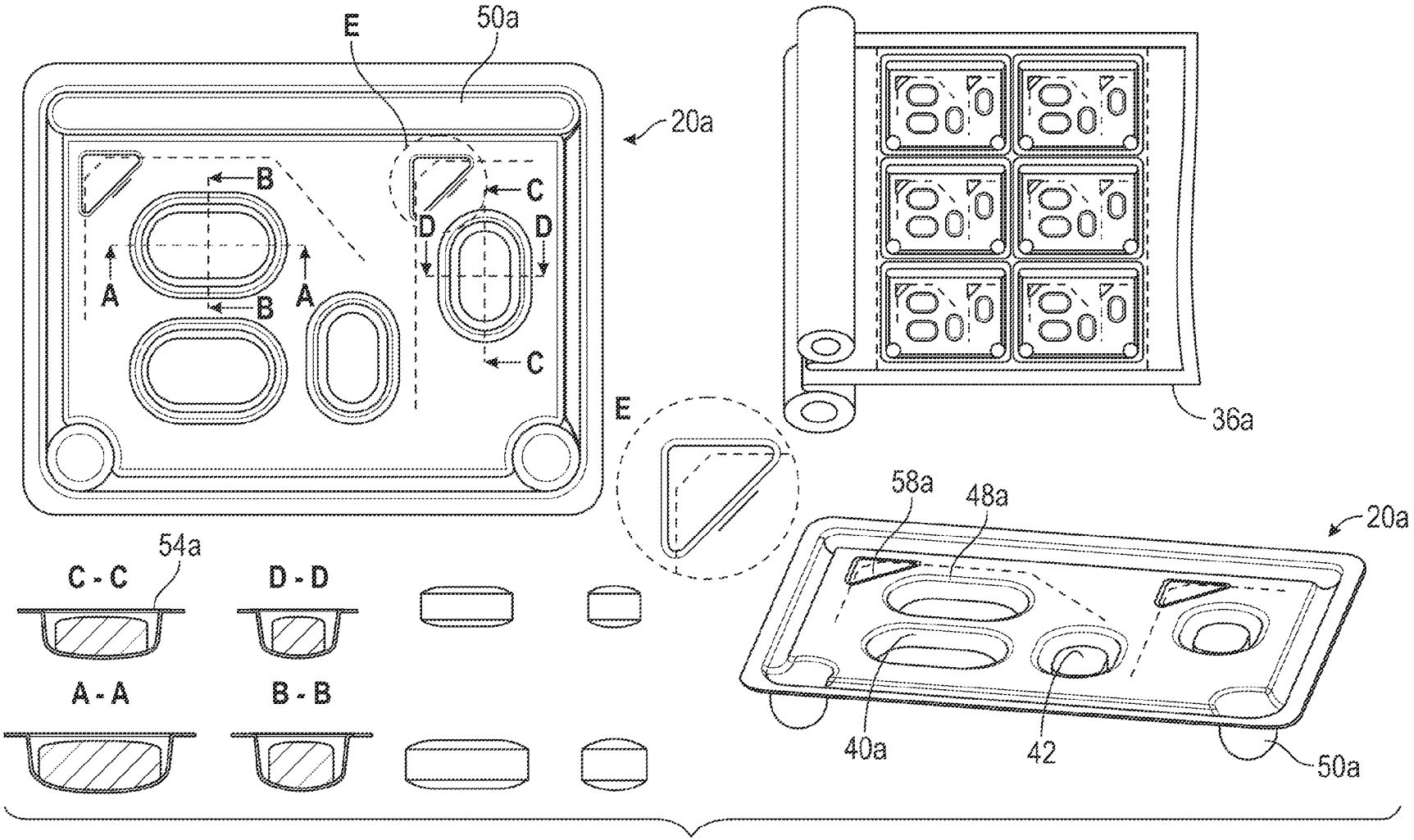
FIG. 10 illustrates engineering drawing specifications of the blister pack of FIGS. 7 and 8.
Figure 11:
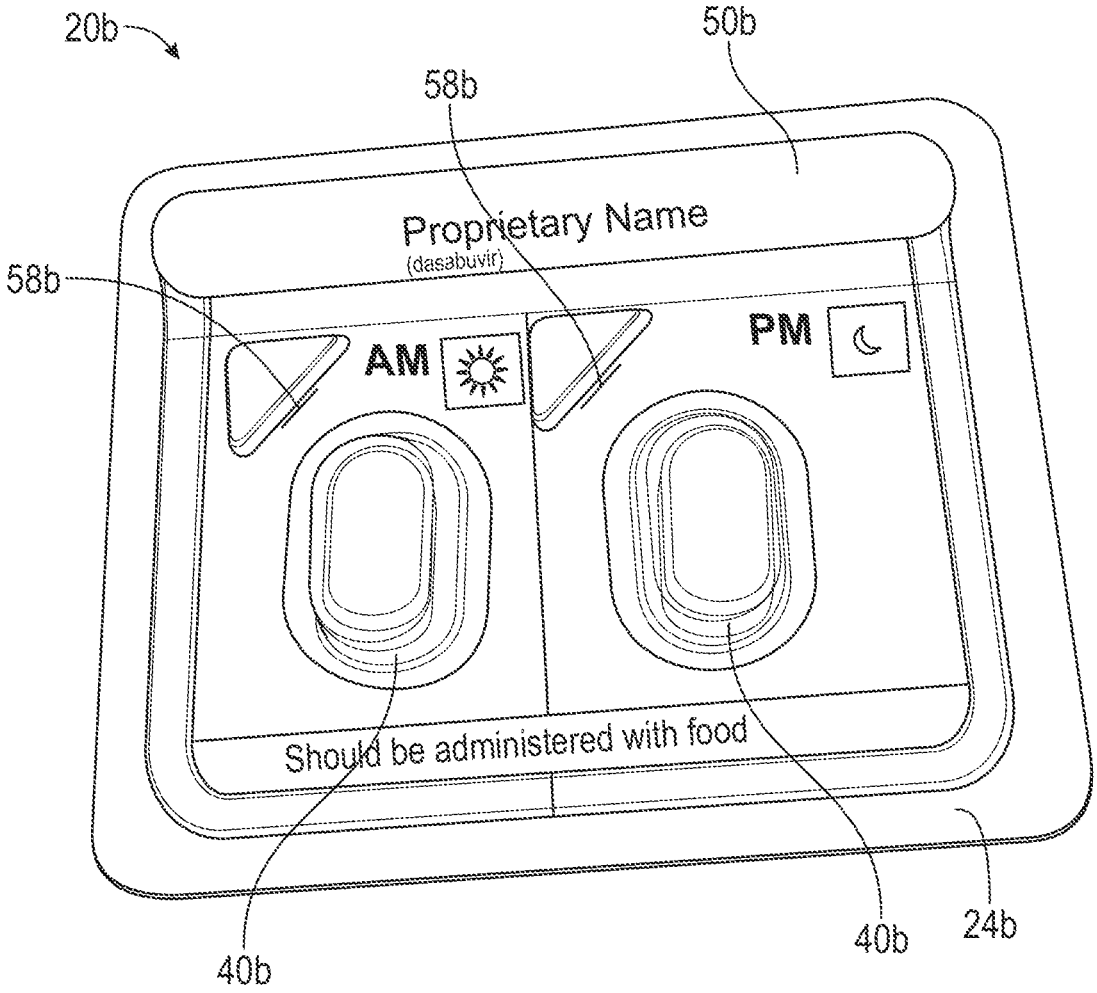
FIG. 11 is a front perspective view of a blister pack having another configuration.

As illustrated in FIGS. 5-11, the blister pack or card 20 includes a first side 24, a second side 26, and outer walls 28 that define a perimeter of the blister pack 20. The blister pack 20 is constructed from a semi-rigid plastic film or member 32 having a foil and/or paper layer 36 adhered to the second side 26 thereof. The blister pack 20 includes a plurality of compartments or pockets 40 formed within the member 32 and sized and shaped to receive a pill-form of a medication 42 therein. The compartments 40 are defined by the semi-rigid plastic film and protrude from the first side 24 of the blister pack 20. As such, the compartments 40 define a height of the blister pack 20. The compartments 40 also define an opening 48 on the second side 26 of the blister pack 20 prior to adhering the film layer 36 in order to insert the at least one medication 42 therein. As illustrated in FIGS. 5 and 6, one or more of the compartments 40 may be empty when sealed thereby defining one or more air pockets or supporting knobs 50 in the blister pack 20. The foil layer 36 overlays the openings 48 when adhered to the second side 26 of the blister pack 20 thereby creating a seal 54 for securing the doses of medication 42 or the air pockets 48 in the appropriate compartment 40. The medication 42 secured in each of the plurality of compartments 40 is accessible by applying pressure to the desired compartment on the first side 24 of the blister pack 20 and thereby puncturing the seal 54 of the compartment 40. The medication is released through the opening 48 of the second side 26

The seals 54 are created by a vacuum in order to enclose the medication 42 within the compartments 40. In the illustrated embodiments, the seals 54 and the compartments 40 enclose the medications 42 such that each of the doses of medication 40 is surrounded and protected by a surrounding air pocket. The air pocket protects the integrity of the dose of medication 40 (e.g., protects the medication from being crushed or prematurely expiring). The foil layer 36 includes one or more perforations or indentations to provide a point where an intended user may push the dose of medication 40 through the foil layer 36 in order to free the medication from the blister pack 20. Alternative or additional embodiments may include blister packs constructed from any suitable material(s) (e.g., cardboard, foam, etc.). Similarly, the compartments may be sealed using suitable alternative methods or materials.

As illustrated in FIGS. 5-11, the blister pack 20 may have a variety of suitable configurations, such as for example blister packs 20, 20*a*, 20*b*. The compartments 40 of the blister packs 20, 20*a*, 20*b* have a variety of sizes and shapes in order to accommodate different types, sizes, and doses of medications 40. For example, the compartments 40 may be circular, ovular, cuboidal, rectangular, and the like. Similarly, the blister pack may include compartments including any suitable combination of shapes and sizes. In other words, because a dose of medication in the form of a pill or capsule may have many sizes and shapes, the blister pack can be manufactured to accommodate the specific size and shape of one or more types of medications. Further, many medications are adapted to be taken multiple times a day, at specific times of the day, and/or in combination with other medications. Therefore, each of the compartments may be sized and shaped to receive different types of medications and in any suitable orientation to specify an order or series of administration. The second side 26 of the blister pack, and specifically the foil layer(s), may have many different configurations of perforations 58. For example, the perforations 58*b* may be located at each compartment 40. Alternatively, the perforations 58*a* may be configured so that only certain compartments 40 are punctured at a time, which will be discussed in greater detail below. The perforations 58 may also aid the user is administering the correct medications at the correct times. Furthermore, the air pockets or support knobs 50 may have alternative positions and configurations. For example, support knobs may be elongated air pockets or ribs 50. The ribs may extend along one or more sides of the blister pack, for example, or may be oriented in other ways relative to one or more of the compartments containing medication. Additionally, support knobs and support ribs may be used together in some embodiments.

FIGS. 5-11 also illustrate that the blister pack 20, 20*a*, 20*b* may be divided into regions or sections 60. For example, in FIGS. 5 and 6, the blister pack 20 is divided into a first region 60, a second region 60', and a third region 60". Each of the first, second, and third regions 60, 60', 60" include at least one of the compartments 40 of the blister pack 20. In the embodiment illustrated in FIGS. 5 and 6, the regions 60, 60', 60" may be separated from one another at a perforated edge or otherwise weakened lines 64 when they are used. In other words, the first region 60 may be torn away from the second and third regions 60', 60". As such, the user may remove the medication (s) within a particular region that may correspond to a certain dosage, combination or time period. The advantage of such a blister pack 20 is that specific medications can be removed from the corresponding compartments 40 without unintentionally puncturing the seals 54 of other, adjacent compartments. Regions of the blister pack may also be delineated by perforations in the second side of the blister pack. For example, FIGS. 7-10 include first and second perforations 58*a*. The perforations 58*a* are configured to provide easy access to the medications of the first region 60*a* while preserving the integrity of the seals 54*a* securing the medications of the second region 60*a*'. In addition to being physically delineated, regions of the blister packs 20 may be color-coded or provided with some other type of indicia to indicate and obviate the difference in the types of medication contained within each region or group of medications.

As noted above with respect to FIGS. 1 and 2A-C, the container assembly 10 includes the puck or template 100. The puck 100 is configured to be complementary to the compartments 40 of the blister pack 20. The puck 100 is a protective device or spacer component that provides a buffer between the blister pack 20 and the box 150. More particularly, the puck 100 provides rigidity to the finished box, deterring children from bending and breaking the perforations on the box around the medication while providing bite protection for the blister pack 20.

Figure 12:
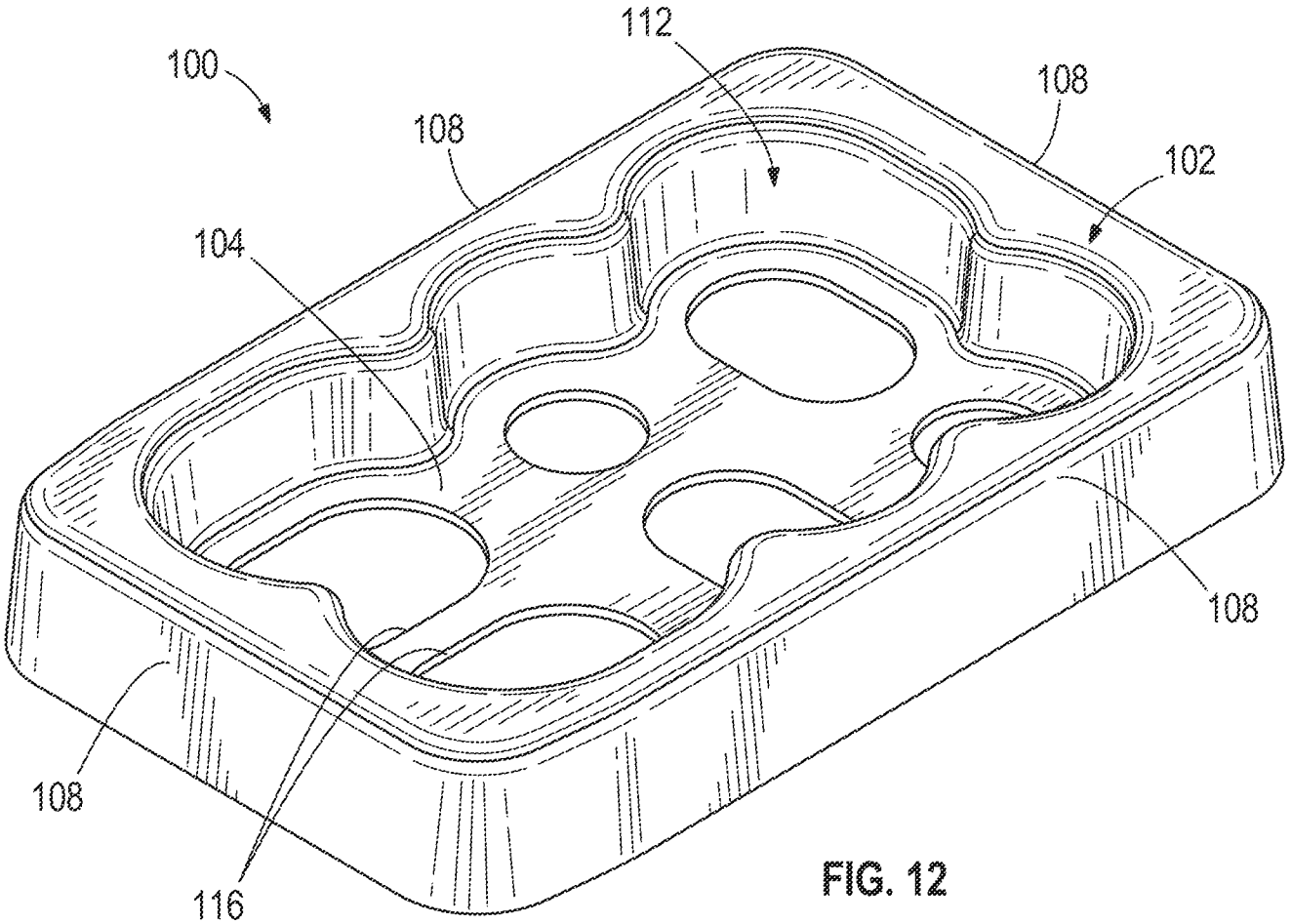
FIG. 12 is a perspective view of an exemplary puck.
Figure 13:
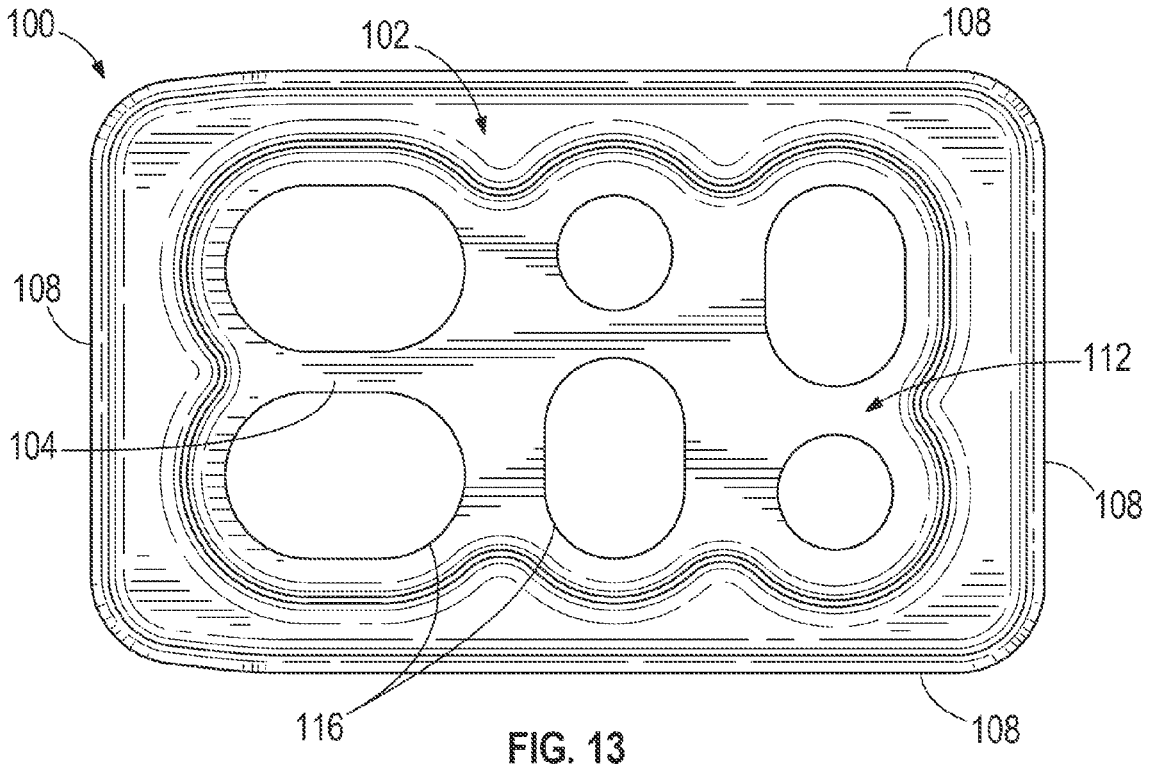
FIG. 13 is a top view of the puck illustrated in FIG. 12.
Figure 14:
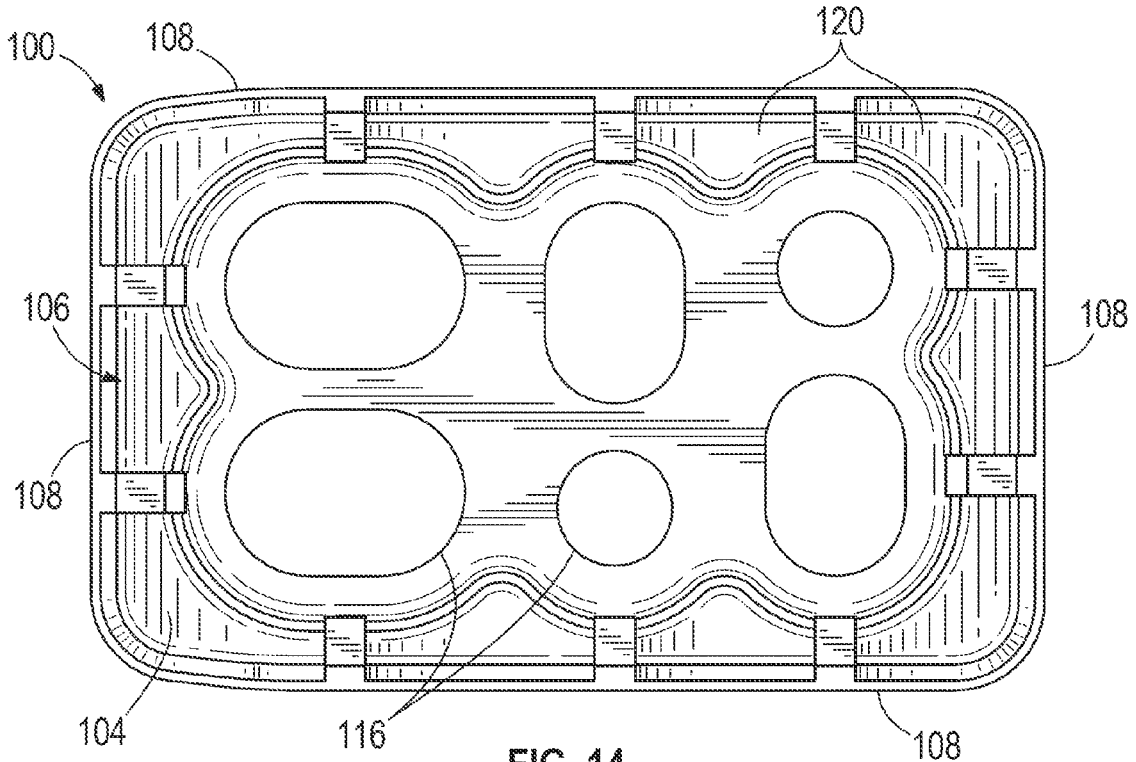
FIG. 14 is a bottom view of the puck illustrated in FIGS. 12-13.
Figure 15:
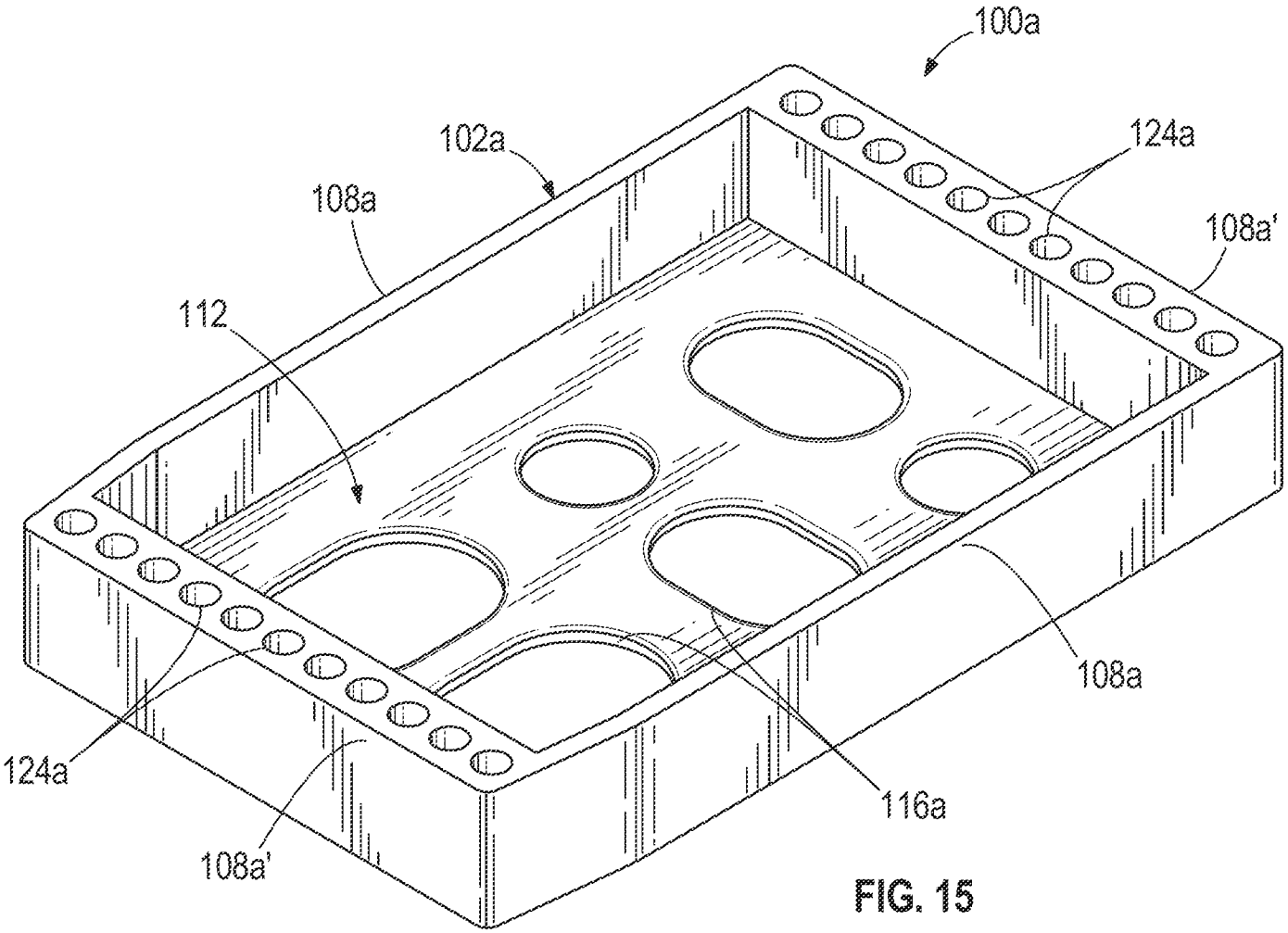
FIG. 15 is a top perspective view of an exemplary puck.
Figure 16:
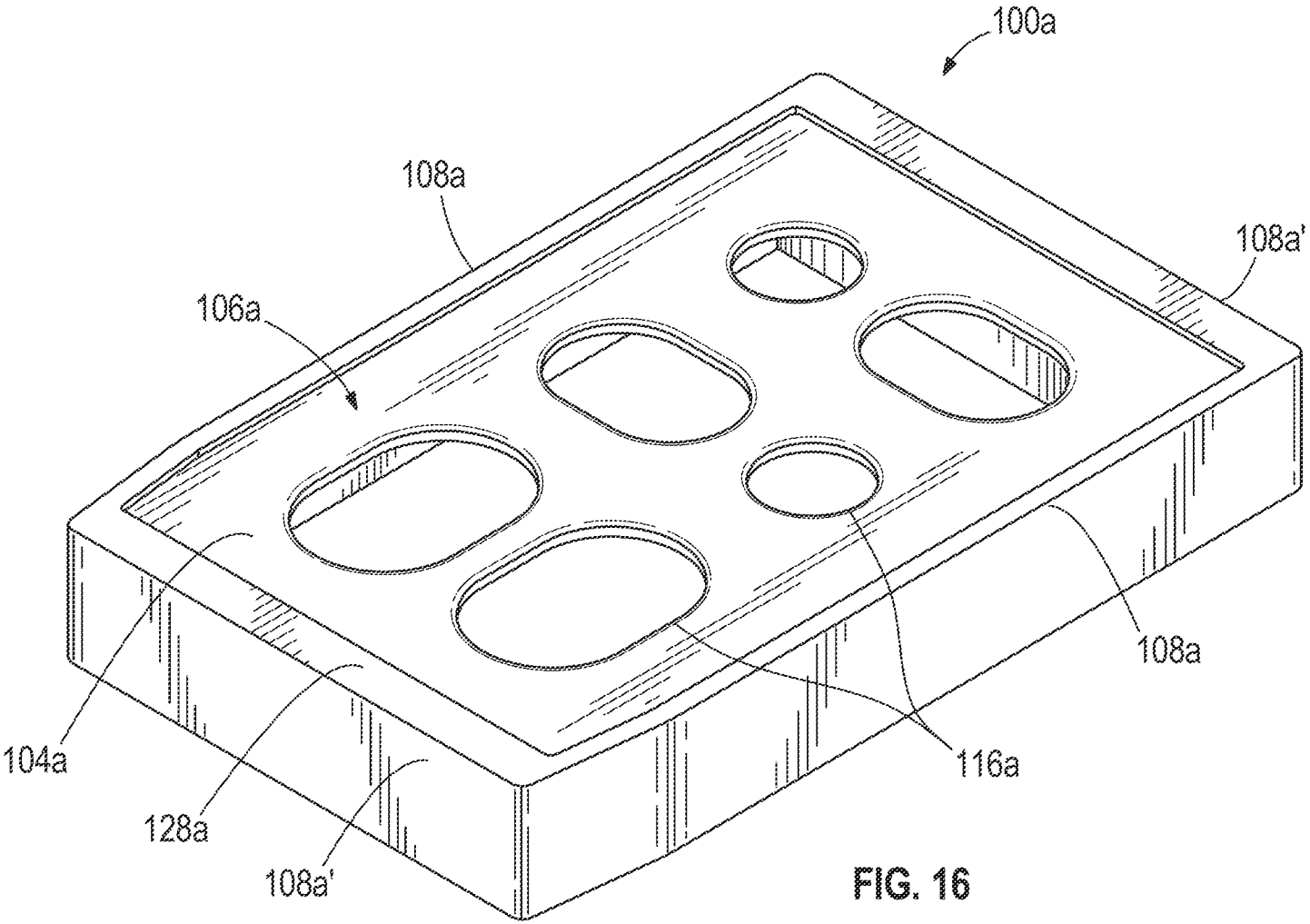
FIG. 16 is a bottom perspective view of the puck in FIG. 15.
Figure 17:
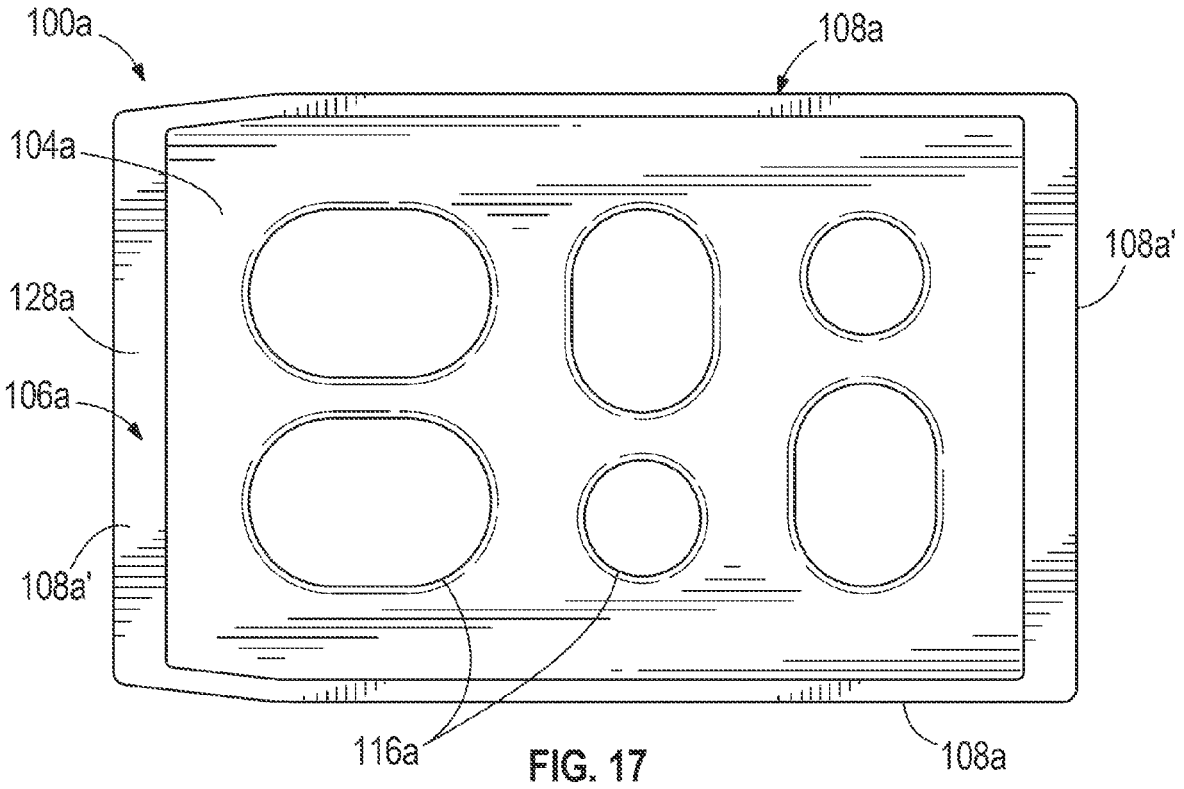
FIG. 17 is a bottom view of the puck illustrated in FIG. 15.
Figure 18:
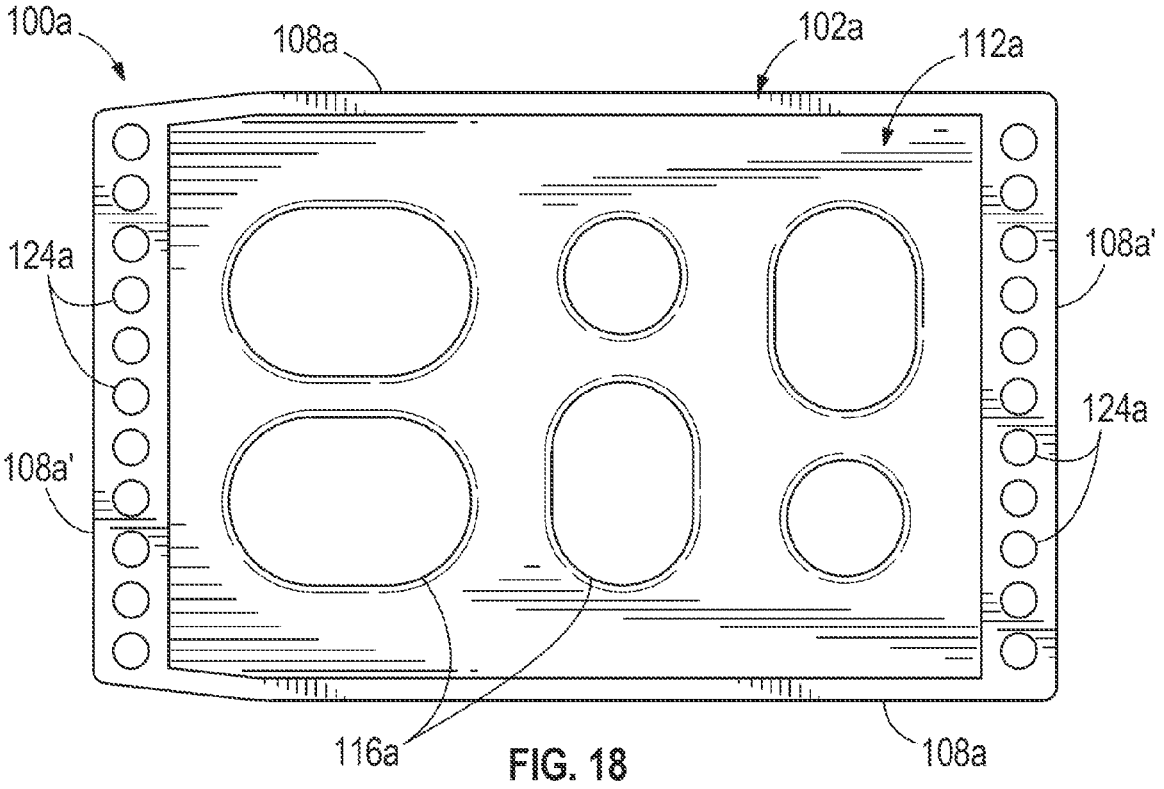
FIG. 18 is a top view of the puck illustrated in FIGS. 15-16.
Figure 19:
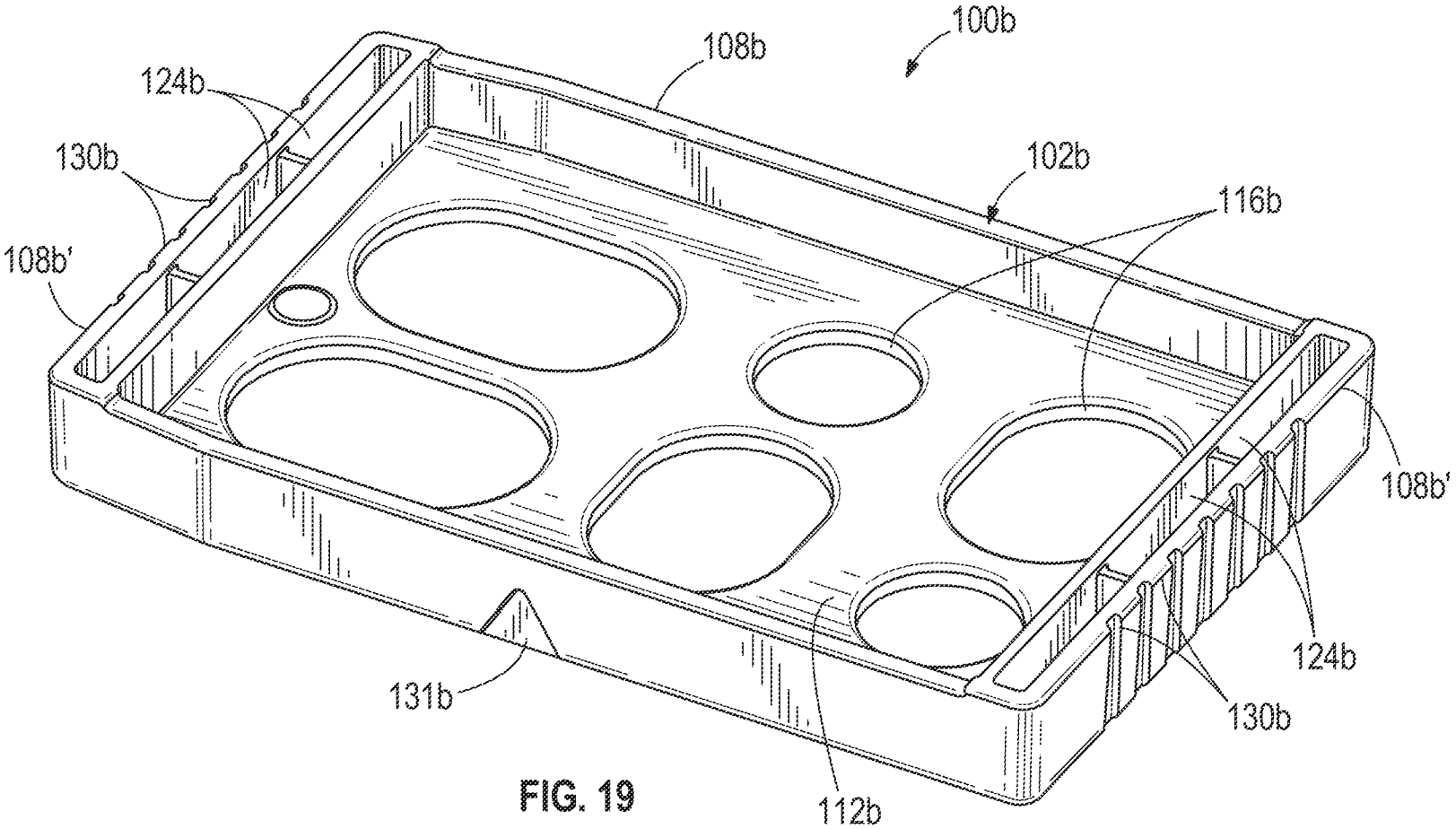
FIG. 19 is a perspective view of an exemplary puck.
Figure 20:
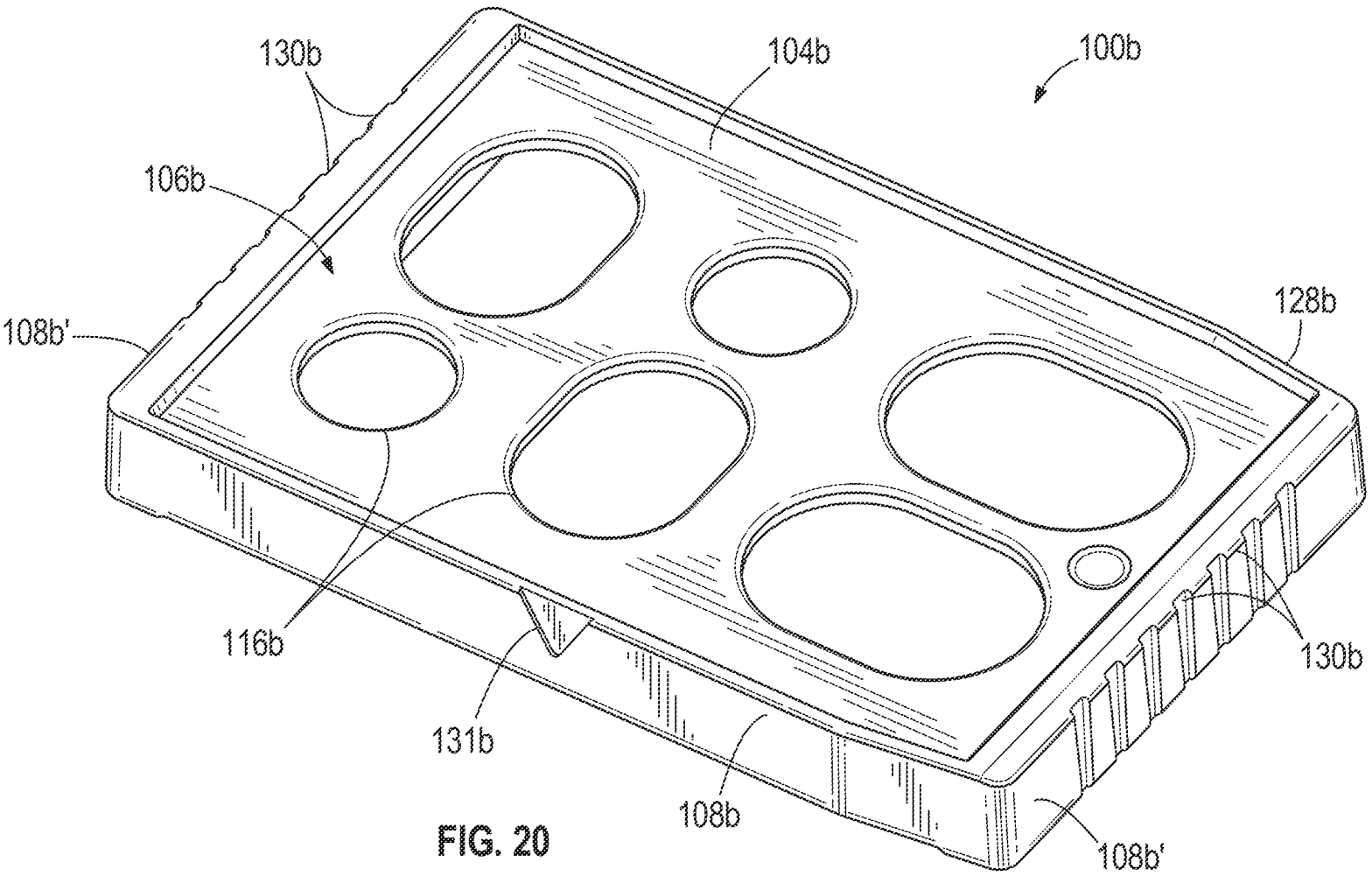
FIG. 20 is a bottom perspective view of the puck in FIG. 19.
Figure 21:
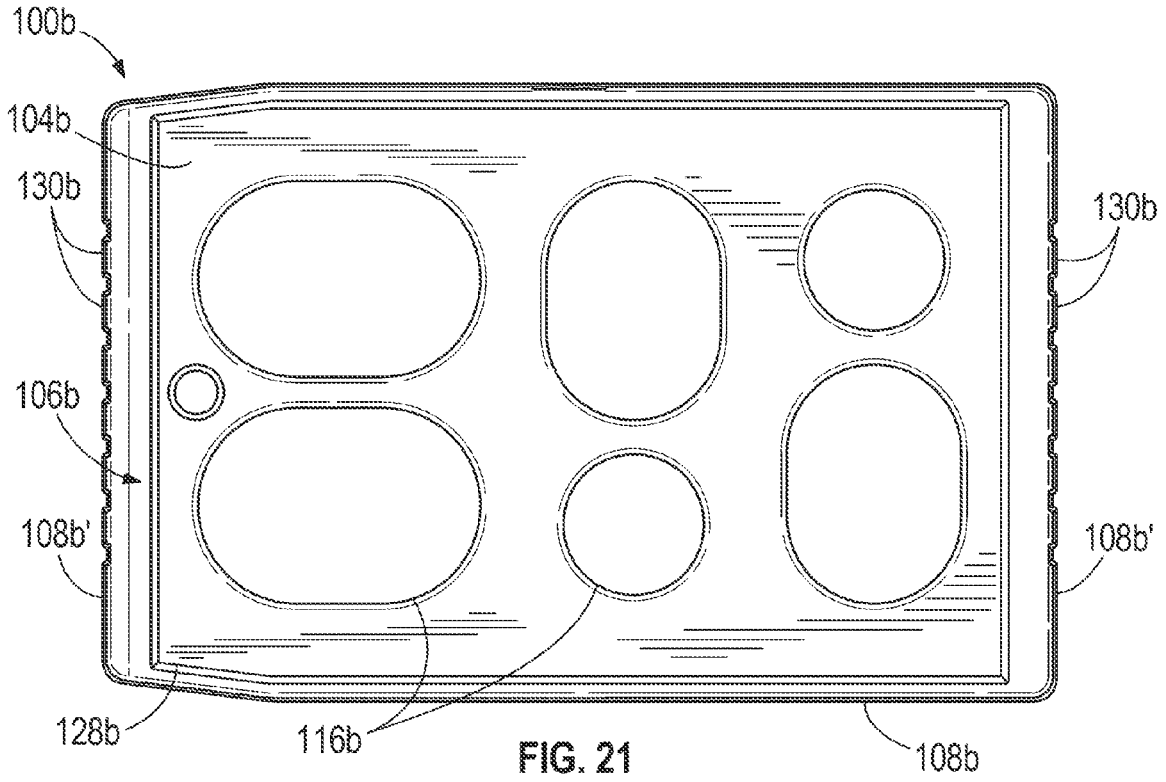
FIG. 21 is a bottom view of the puck in FIG. 19.
Figure 22:
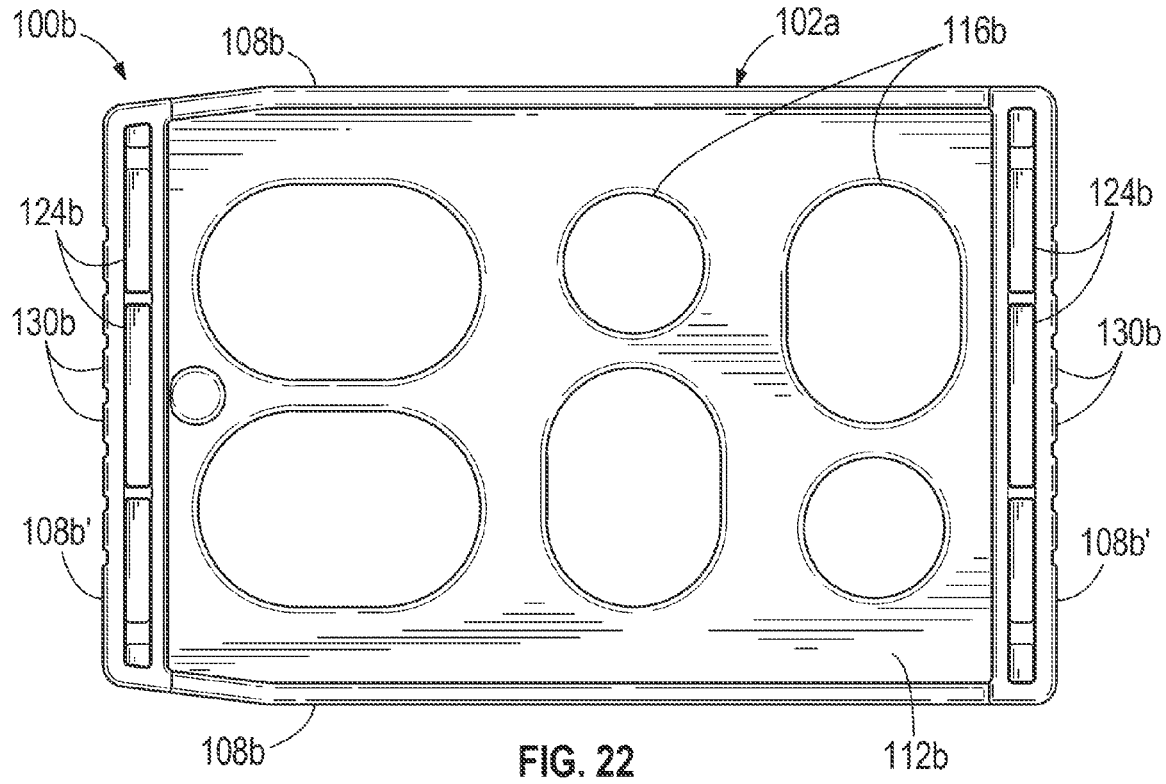
FIG. 22 is a top view of the puck illustrated in FIG. 19.
Figure 23:
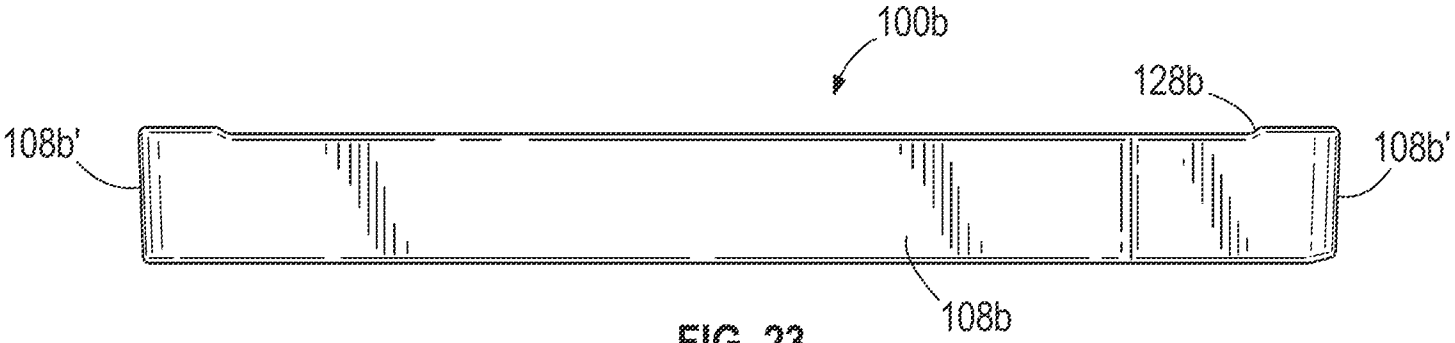
FIG. 23 is a rear view of the puck illustrated in FIG. 19.
Figure 24:
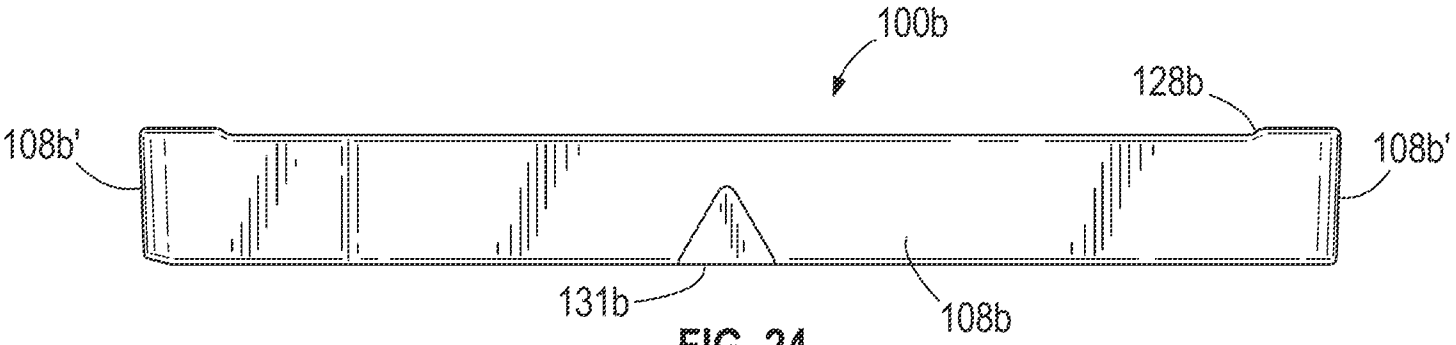
FIG. 24 is a front view of the puck illustrated in FIG. 19.
Figure 25:
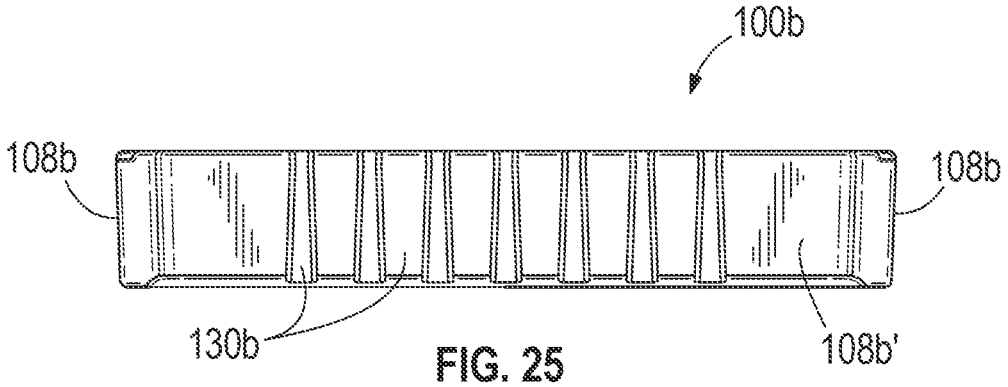
FIG. 25 is a left side view of the puck illustrated in FIG. 19.
Figure 26:
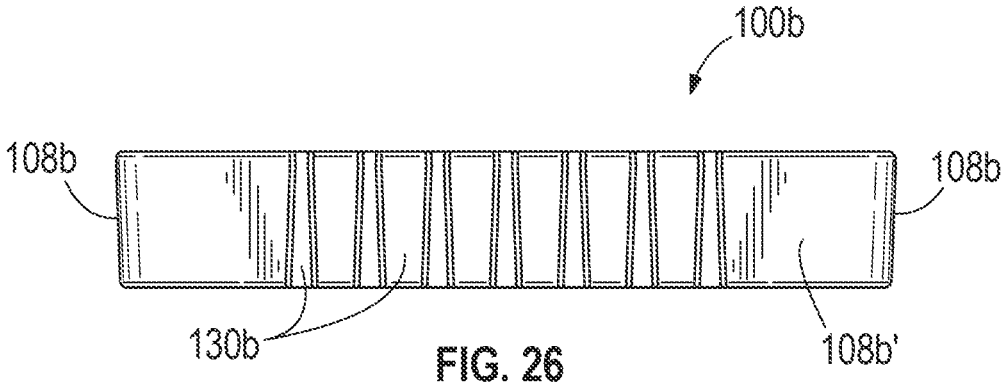
FIG. 26 is a right side view of the puck illustrated in FIG. 19.
Figure 35:
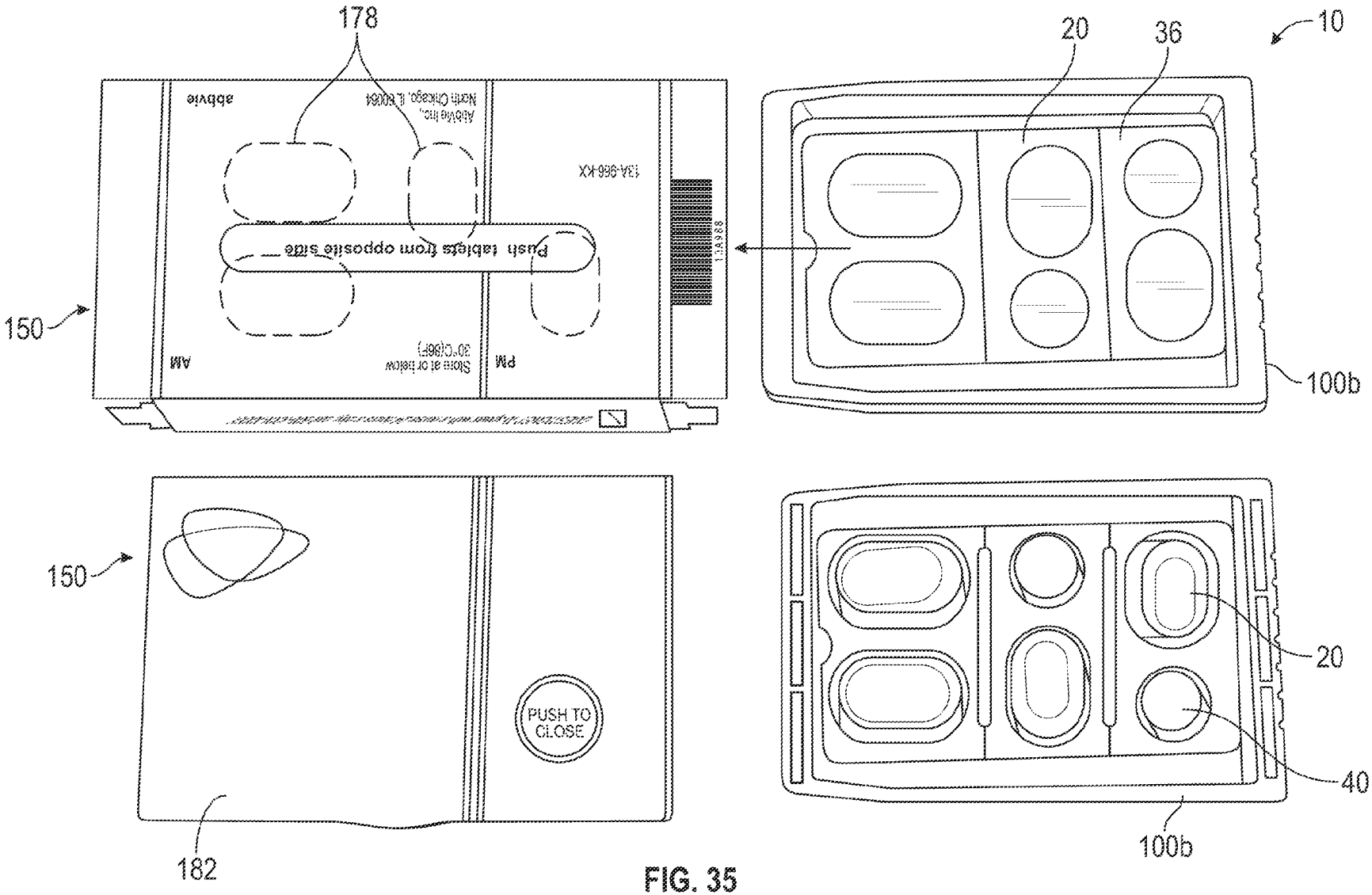
FIG. 35 illustrates a method for assembling the medicine container assembly of FIG. 33.

FIGS. 12-26 illustrate three different pucks 100. FIGS. 12-14 illustrate a first embodiment of the puck 100. The puck 100 includes a body portion 104 having a first side 102 spaced apart and opposite a second side 106. The body 104 also includes walls 108 extending between the first and second sides. The walls 108 define a height of the puck 100. The puck 100 also includes a recess 112 in the body 104. The puck 100 includes a plurality of openings 116 formed within the recess 112. Each of the plurality of openings 116 in the puck 100 is complementary to one of the compartments 40 of the blister pack 20, described above. As such, the openings 116 in the puck 100 are configured to align with the compartments 40 on the blister pack 20 having a specific orientation. For example, the puck 100 of FIGS. 12-14 is specifically configured to accommodate the blister pack 20 illustrated in FIGS. 5 and 6. The blister pack 20 is coupled to the second side 106 of the puck 100 such that each of the compartments 40 is inserted through the respective complementary opening 116 in the puck 100. In some constructions, the blister pack 20 is applied (e.g., glued, sealed, taped, etc.) to the second side 106 of the puck 100 (this is shown in FIG. 35 as well).

With continued reference to FIGS. 12-14, the second side 106 of the body 104 includes a plurality of reinforced cavities 120 extending between the walls 108 and the recess 112. In other embodiments, the second side 106 may be solid. Additionally, FIGS. 13 and 14 include walls 108 that each have substantially the same thickness. However, alternate or additional embodiments may include walls having different thicknesses. The puck 100 can comprise paper pulp or other paper based substrates, however other materials, such as, plastic, or other suitable materials or combinations of materials may also be utilized in puck 100.

FIGS. 15-18 illustrate a second embodiment of the puck (referred to as puck 100*a*). The puck 100*a* includes a body portion 104*a* having a first side 102*a* spaced apart and opposite a second side 106*a*. The body 104*a* also includes walls 108*a* extending between the first and second sides. The walls 108*a*, 108*a*' define a height of the puck 100*a*. The puck 100*a* also includes a recess 112*a* in the body 104*a*. The puck 100*a* includes a plurality of openings 116*a* formed within the recess 112*a*. Each of the plurality of openings 116*a* in the puck 100*a* is complementary to one of the compartments 40 of the blister pack 20, described above. As such, the openings 116*a* in the puck 100*a* are configured to align with the compartments 40 on the blister pack 20 having a specific orientation. For example, the puck 100*a* of FIGS. 15-18 is specifically configured to accommodate the blister pack 20 illustrated in FIGS. 5 and 6. The blister pack 20 is coupled to the second side 106*a* of the puck 100*a* such that each of the compartments 40 is inserted through the respective complementary opening 116*a* in the puck 100*a*. In some constructions, the blister pack 20 is applied (e.g., glued, sealed, taped, etc.) to the second side 106*a* of the puck 100*a* (this is shown in FIG. 35 as well).

With continued reference to FIGS. 15-18, the walls 108*a* and 108*a*' have varying thicknesses. For example, the thickness of the wall 108*a* is different than the thickness of the wall 108*a*'. As illustrated, the thickness of the wall 108*a* is less than the thickness of the wall 108*a*'. The walls 108*a*' also includes a plurality of apertures 124*a*. The apertures 124*a* are cylindrical, and while eleven cylindrical apertures are illustrated, there may be fewer or more cylindrical apertures in other constructions. The walls 108*a*, 108*a*' form a raised rim 128*a* around a perimeter of the bottom wall (see FIGS. 16-17). The walls 108*a* angle inwardly at one end of the puck 100*a*. The angled portion of the wall 108*a* allows for easier insertion of the puck 100*a* into the box 150. The puck 100*a* can comprise plastic and be manufactured using an injection molding process, however, other suitable materials or combinations of materials may also be utilized for the puck 100*a*.

FIGS. 19-26 illustrate a third embodiment of the puck (referred to as puck 100*b*). The puck 100*b* includes a body portion 104*b* having a first side 102*b* spaced apart and opposite a second side 106*b*. The body 104*b* also includes walls 108*b* extending between the first and second sides. The walls 108*b*, 108*b*' define a height of the puck 100*b*. The puck 100*b* also includes a recess 112*b* in the body 104*b*. The puck 100*b* includes a plurality of openings 116*b* formed within the recess 112*b*. Each of the plurality of openings 116*b* in the puck 100*b* is complementary to one of the compartments 40 of the blister pack 20, described above. As such, the openings 116*b* in the puck 100*b* are configured to align with the compartments 40 on the blister pack 20 having a specific orientation. For example, the puck 100*b* of FIGS. 19-26 is specifically configured to accommodate the blister pack 20 illustrated in FIGS. 5 and 6. The blister pack 20 is coupled to the second side 106*b* of the puck 100*b* such that each of the compartments 40 is inserted through the respective complementary opening 116*b* in the puck 100*b*. In some constructions, the blister pack 20 is applied (e.g., glued, sealed, taped, etc.) to the second side 106*a* of the puck 100*b* (this is shown in FIG. 35 as well).

With continued reference to FIGS. 19-26, the walls 108*b* and 108*b*' have varying thicknesses. For example, the thickness of the wall 108*b* is different than the thickness of the wall 108*b*'. As illustrated, the thickness of the wall 108*b* is less than the thickness of the wall 108*b*'. The walls 108*b*' also includes a plurality of apertures 124*b*. The apertures 124*b* are rectangular, and while three rectangular apertures are illustrated, there may be fewer or more rectangular apertures in other constructions. The walls 108*b*, 108*b*' form a raised rim 128*b* around a perimeter of the bottom wall (see FIGS. 20-21). The walls 108*b* angle inwardly at one end of the puck 100*b*. The angled portion of the wall 108*b* allows for easier insertion of the puck 100*b* into the box 150.

The walls 108*b*, 108*b*' include a ribbed surface 130*b* at the outer ends of the walls. The ribbed surface 130*b* provides a larger surface area for application of glue or other bonding material(s) for securing the puck 100*b* to the box 150. The puck 100*b* can comprise plastic, and be manufactured using an injection molding process, however, other suitable materials or combinations of materials may also be utilized for the puck 100*b*.

Figure 27A:
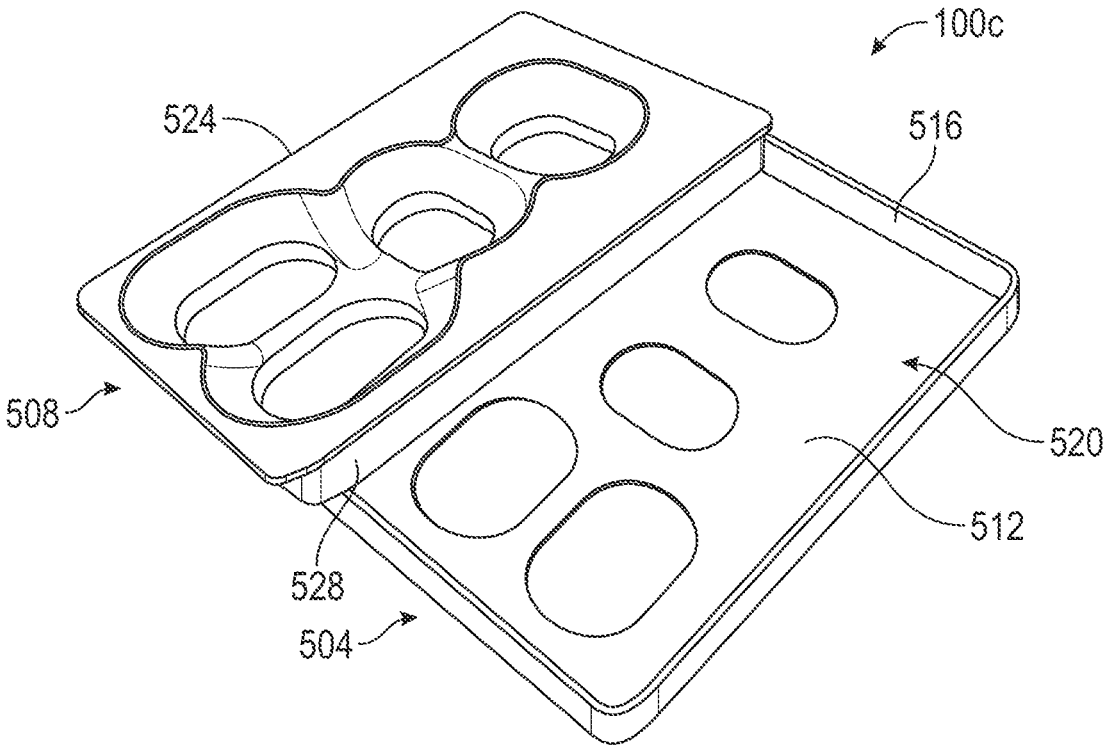
FIGS. 27A, 27B, 27C illustrate front perspective views of an exemplary puck.
Figure 27B:
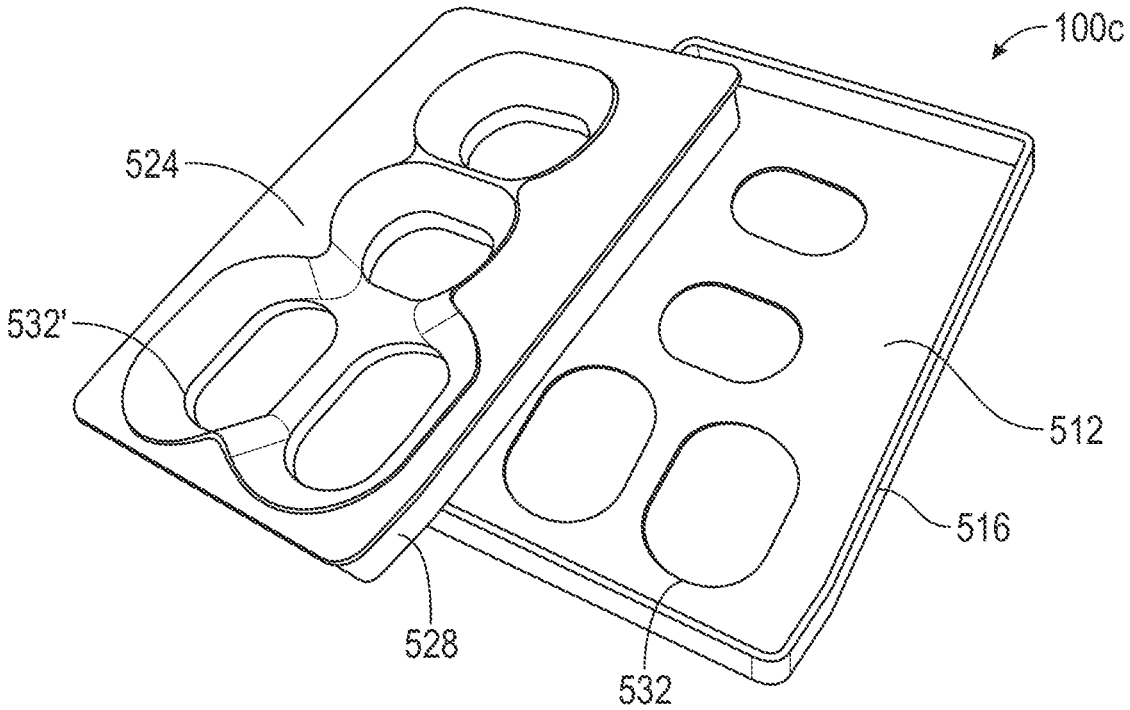
Figure 27C:
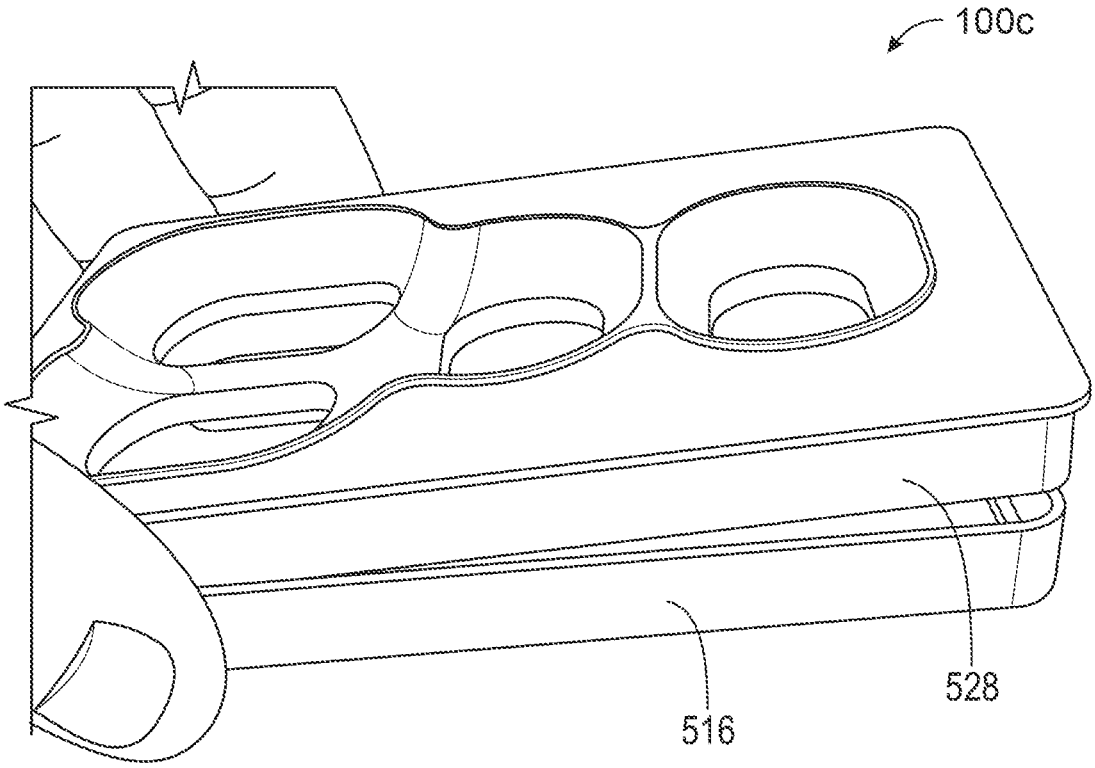

FIGS. 27A-C illustrate a fourth embodiment of the puck (referred to as puck 100*c*). The puck 100*c* includes a first portion 504 and a second portion 508 that are configured to couple together as illustrated. For example, the first portion 504 has a bottom wall 512 and a side wall 516 that extends around a perimeter of the bottom wall 512 thereby defining a recess 520. The second portion 508 includes a top wall 524 having a defined perimeter and a side wall 528 that extends from the top wall 524 at a position inset from the perimeter. The top wall 524 includes a overhang that extends over or beyond the side wall 528 and that rests on the top of the side wall 516. This configuration allows the side wall 528 of the second portion 508 to slide or fit within the recess 520 of the first portion 504.

The first portion includes a plurality of openings 532 positioned within the bottom wall 512. The second portion includes a plurality of openings 532' positioned within the top wall 524 and substantially aligned with the openings 532. An area 536 around each of the plurality of openings 532' is scalloped where a portion of the top wall 524 is gradually removed with less material being removed as the area transitions from the opening 532' and moving outwardly. The blister pack 20*a* is positioned between the first portion 504 and the second portion 508 and the compartments aligned with the openings 532, 532' before inserting the puck 100*c* into the box 150.

Figure 28A:
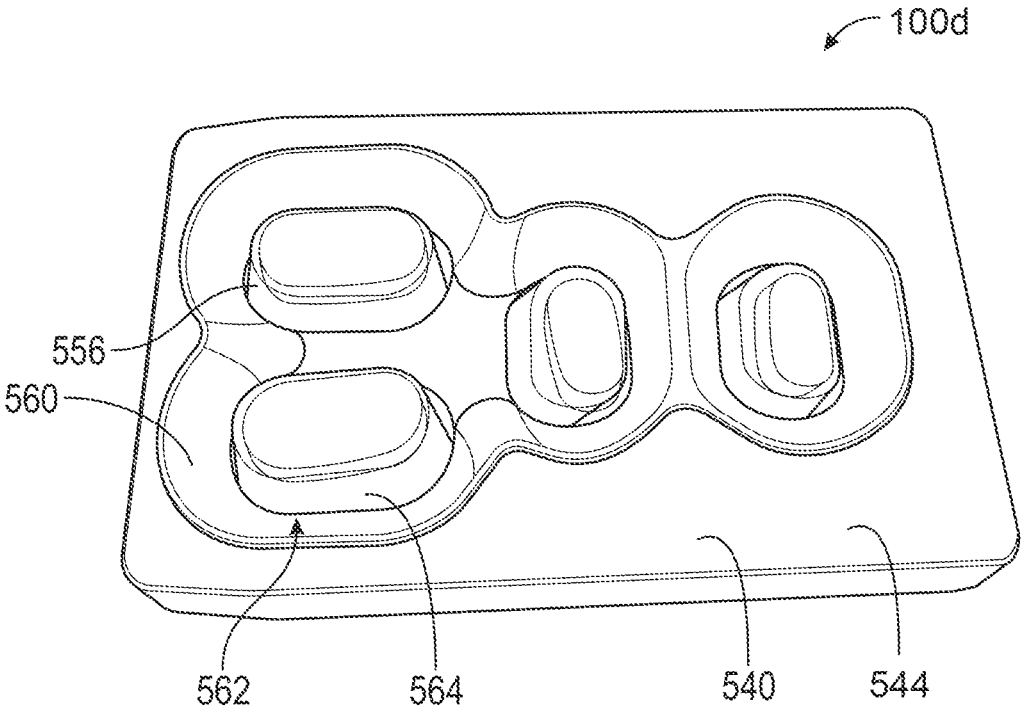
FIG. 28A illustrates a front perspective view of an exemplary puck.
Figure 28B:
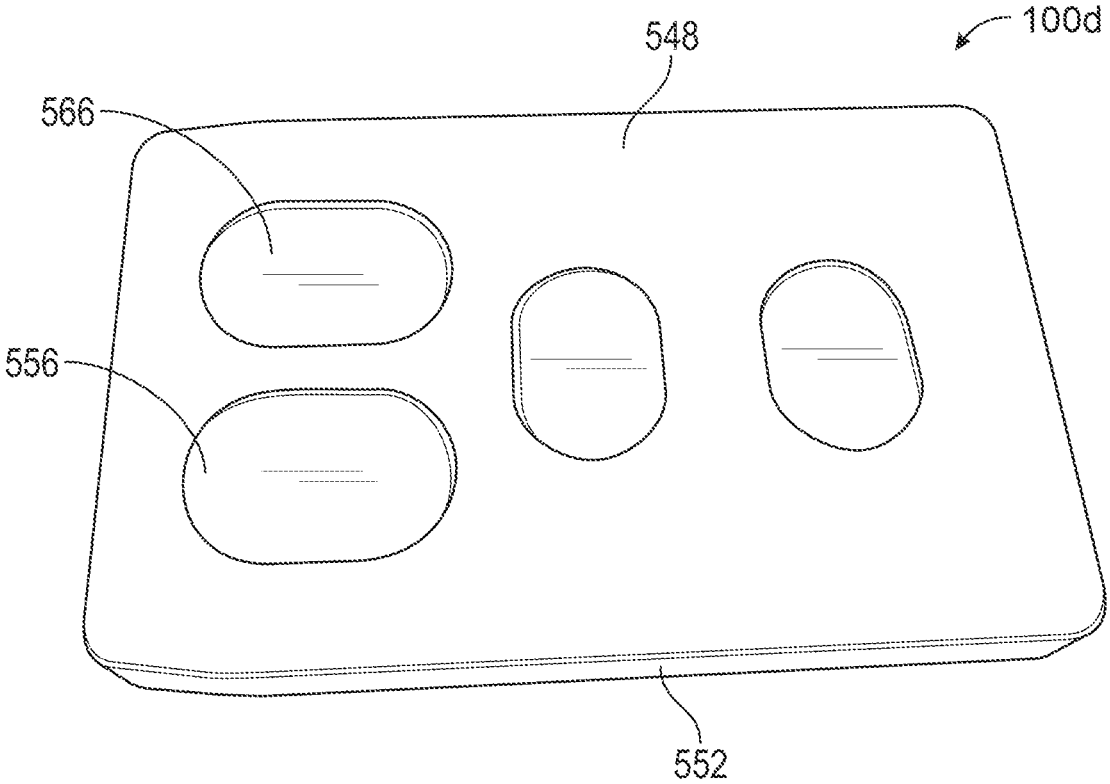
FIG. 28B illustrates a rear perspective view of the puck illustrated in FIG. 28A.

FIGS. 28A-B illustrate a fifth embodiment of the puck (referred to as puck 100*d*). The puck 100*d* includes a base 540 having a top surface 544 and a bottom surface 548 thereby defining a thickness therebetween. The base 540 includes a sidewall 552 extending between the top surface 544 and the bottom surface 548 and defining a perimeter. The side wall 552 may be angled at an end of the base 540. The base 540 includes a plurality of openings 556. The top surface 544 includes an area 560 around all of the openings 556 that is scalloped where a portion of the top surface 544 is gradually removed with less material being removed as the area transitions from the opening 556 and moving outwardly.

The puck 100*d* includes a plurality of individual compartments 562 formed by a first layer of material 564 and a second layer of material 566. The individual compartments 562 support the medication, and the first and second layers of material are secured to the base 540. After the medication and compartments 562 are secured to the base 540, the puck 100*d* is inserted into the box 150.

Figure 29A:
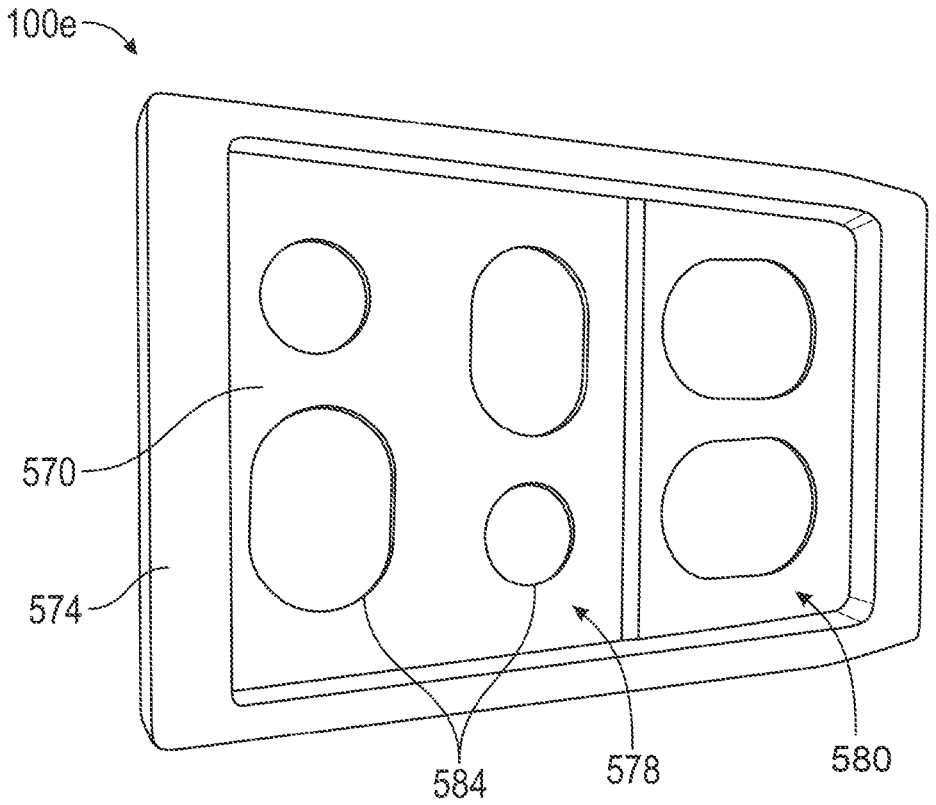
FIG. 29A illustrates a front perspective view of an exemplary puck.
Figure 29B:
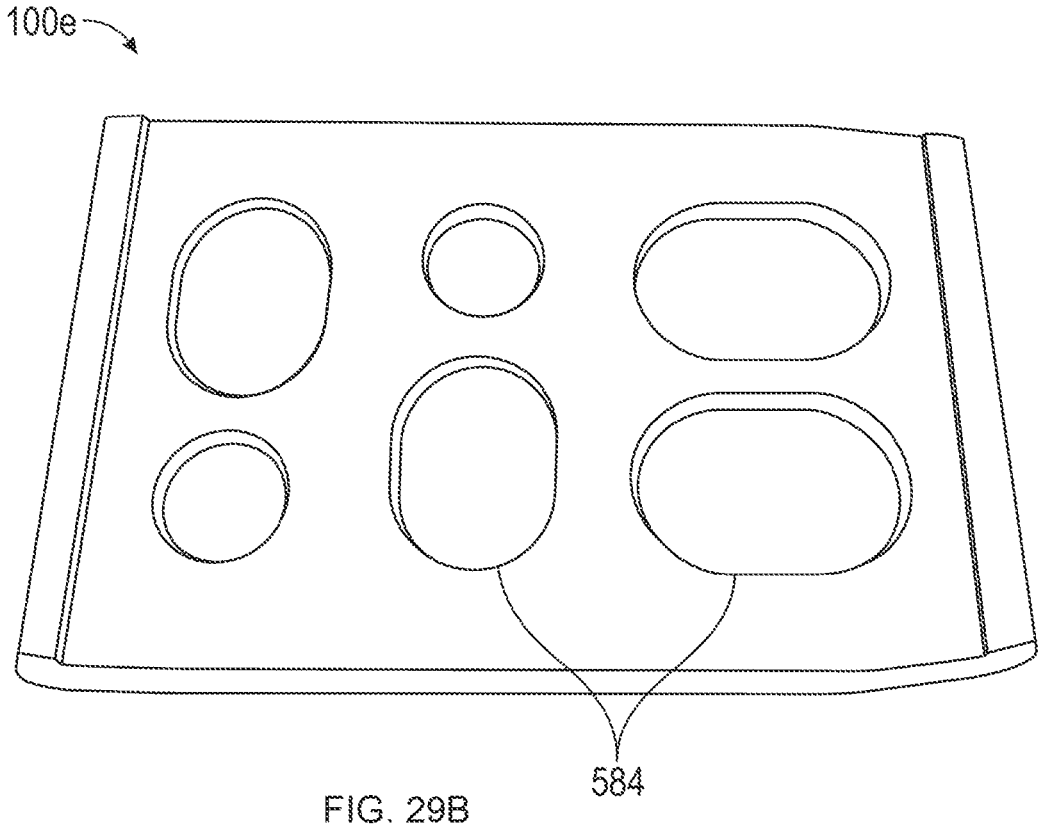
FIG. 29B illustrates a rear perspective view of the puck illustrated in FIG. 29A.

FIGS. 29A-B illustrate a sixth embodiment of the puck (referred to as puck 100*e*). The puck 100*e* includes a bottom wall 570 and a side wall 574 extending around the bottom wall 570. The side wall 574 can include varying thicknesses. As illustrated the two end walls (the shorter walls) have a greater thickness than the front and back walls (the longer walls). As illustrated, the side wall is angled at an end of the puck 100*e*. The bottom wall 570 includes a first portion 578 having a first thickness and a second portion 580 having a second thickness. As illustrated, the second portion 580 has a greater thickness than the first portion 578, however the first portion 578 in other constructions can have a greater thickness. The bottom wall 570 includes a plurality of openings 584. The blister pack 20 is coupled to the puck 100*e* with the compartments aligned with the openings 584 before inserting the puck 100*e* into the box 150.

Figure 30A:
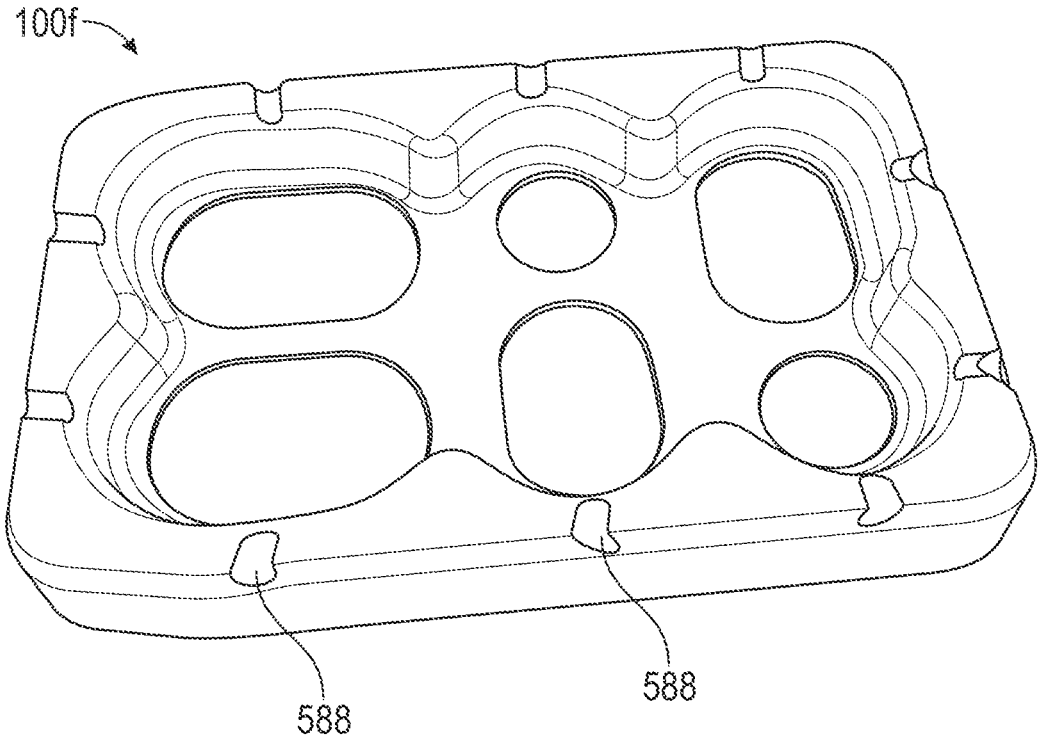
FIG. 30A illustrates a front perspective view of an exemplary puck.
Figure 30B:
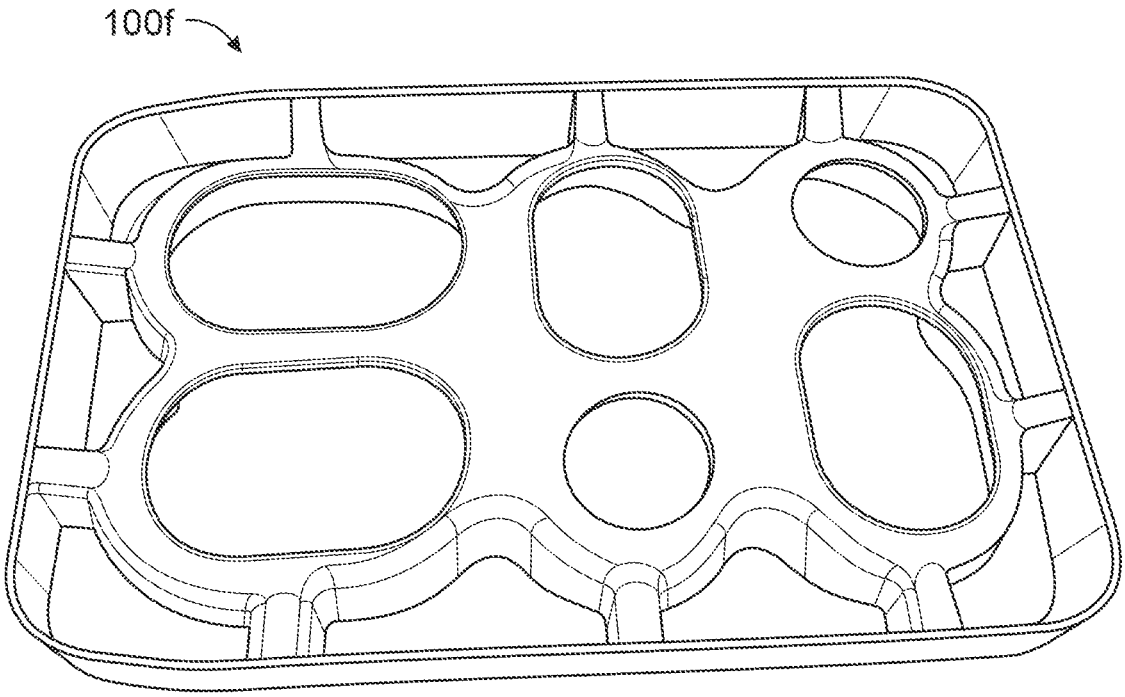
FIG. 30B illustrates a rear perspective view of the puck illustrated in FIG. 30A.

FIGS. 30A-B illustrate a seventh embodiment of the puck (referred to as puck 100*f*). The puck 100*f* is similar to the puck 100 described above. The puck 100*f* includes a plurality of recesses 588 formed at various locations around a perimeter of the puck 100*f*.

Figure 31A:
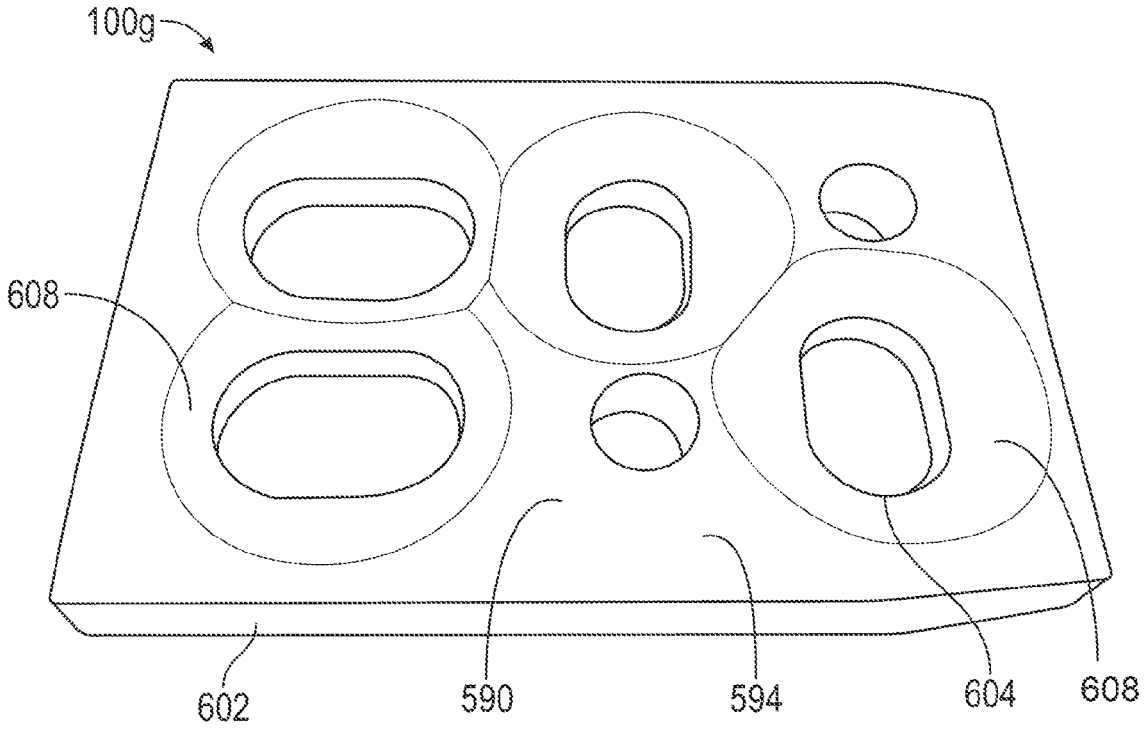
FIG. 31A illustrates a front perspective view of an exemplary puck.
Figure 31B:
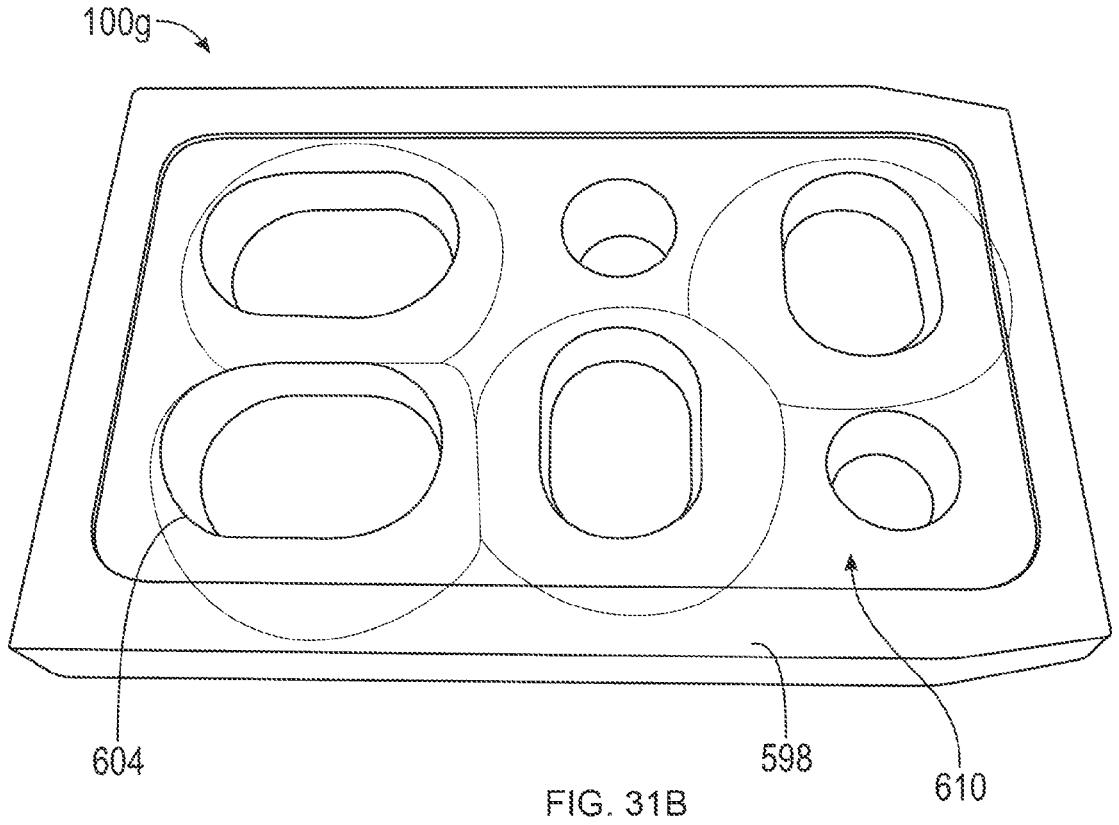
FIG. 31B illustrates a rear perspective view of the puck illustrated in FIG. 31A.

FIGS. 31A-B illustrate an eighth embodiment of the puck (referred to as puck 100*g*). The puck 100*g* includes a base 590 having a top surface 594 and a bottom surface 598 thereby defining a thickness therebetween. The base 590 includes a sidewall 602 extending between the top surface 594 and the bottom surface 598 and defining a perimeter. The side wall 602 may be angled at an end of the base 590. The base 590 includes a plurality of openings 604. The top surface 594 includes an area 608 around some of the openings 604 that is scalloped where a portion of the top surface 594 is gradually removed with less material being removed as the area transitions from the opening 604 and moving outwardly. The bottom surface 598 includes a recessed area 610 around all of the openings 604. The blister pack 20 is coupled to the puck 100*g* with the compartments aligned with the openings 604 before inserting the puck 100*g* into the box 150.

The pucks 100, 100*a-g* of FIGS. 12-18 and 27-31 may also include ribbed surfaces as described above. Additionally, the ribbed surfaces may be included on additional or alternative surfaces and sides of the pucks 100, 100*a-g*. Further, although only illustrated in puck 100*b*, there may be a recess or other indicia 131*b* (e.g., orientation arrow) that indicates an orientation for which the puck 100*b* should be loaded when assembling the medicine container 10.

The pucks 100, 100*a-g* illustrated and described herein are merely exemplary. Pucks having additional configurations and features are within the scope and spirit of the invention. Therefore, it should be understood that the configuration of the plurality of openings may be adapted to any unique configuration of blister pack. Additionally, body portion, walls, and recess may have any suitable shape or size or dimension. Furthermore, the illustrated pucks may be formed from a composite material including paper pulp and bamboo fiber. The pulp/fiber combination is advantageous because it is environmentally safe and recyclable. However, other materials may be used to form the puck.

Figure 32:
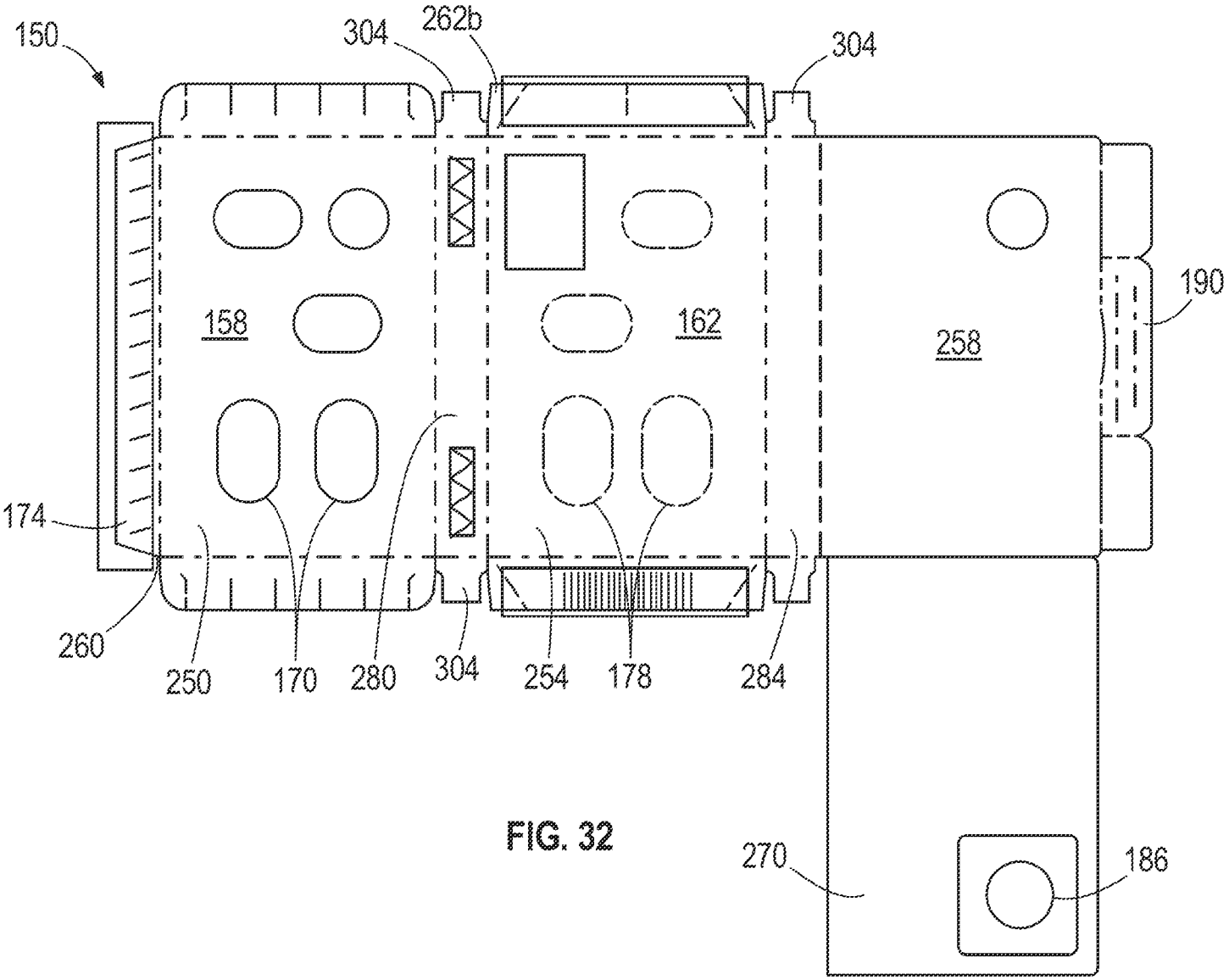
FIG. 32 illustrates an exemplary box blank.
Figure 33:
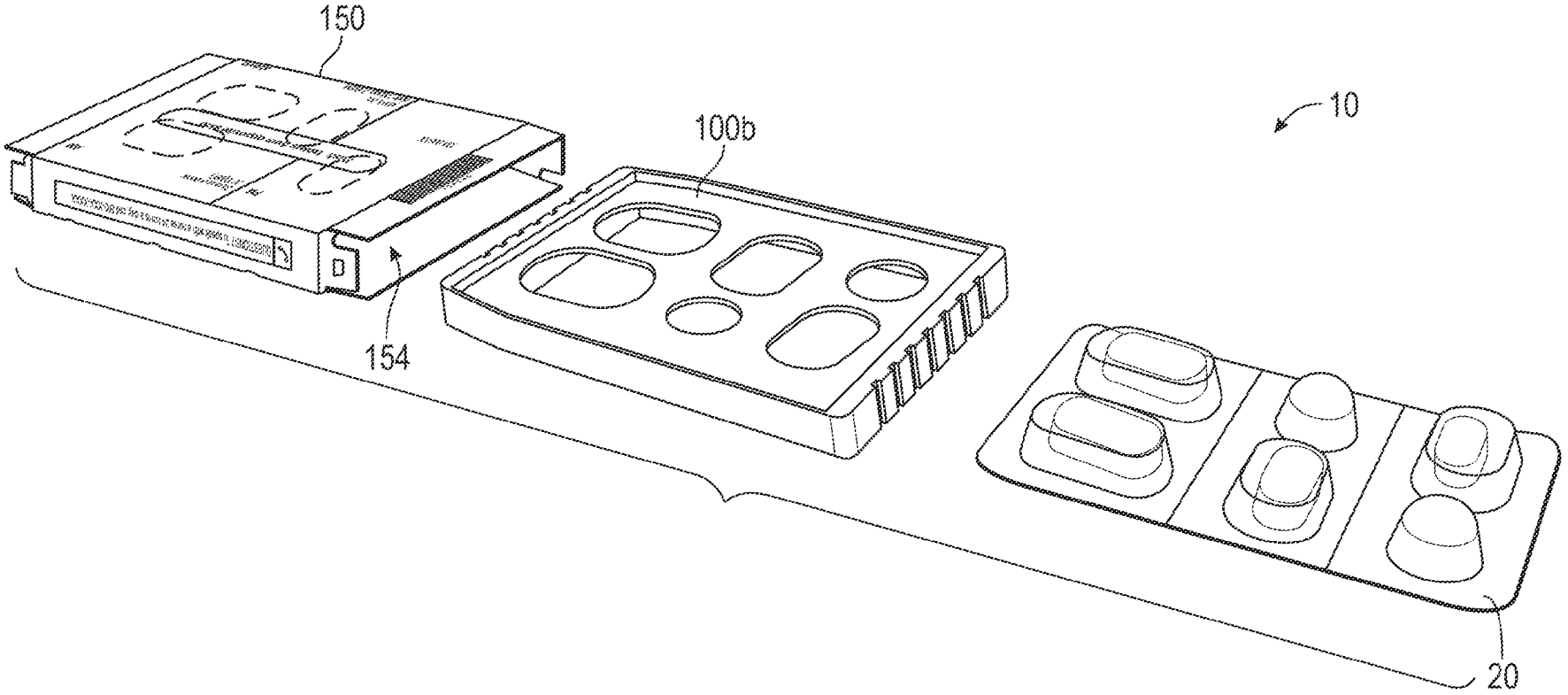
FIG. 33 is an assembly view of the medicine container assembly illustrated in FIGS. 3-4 including the blister pack of FIGS. 5-6, the puck of FIGS. 19-26, and a box.
Figure 34:
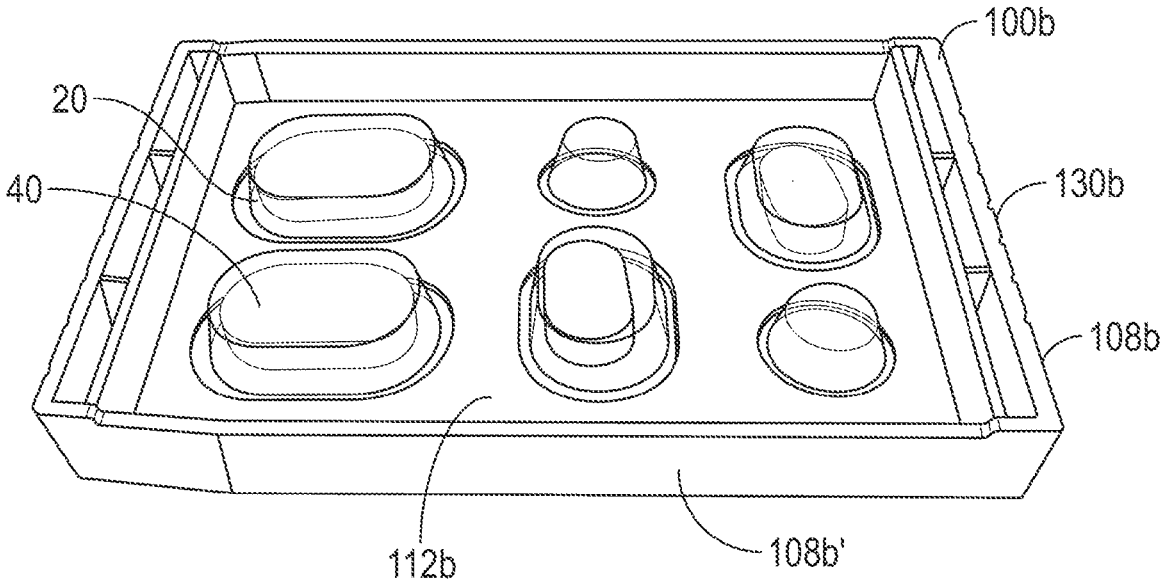
FIG. 34 is a perspective view of the blister pack and puck illustrated in FIG. 33 when assembled.

As noted above with respect to FIGS. 1 and 2A-C, the medicine container assembly 10 includes the box 150. With reference to FIG. 32, the box 150 is constructed from a substrate such as, fiberboard, cardboard or the like. The substrate is processed and cut into a box blank as illustrated in FIG. 32. The box blank is manipulated and folded where noted to form the box 150.

Figure 3:
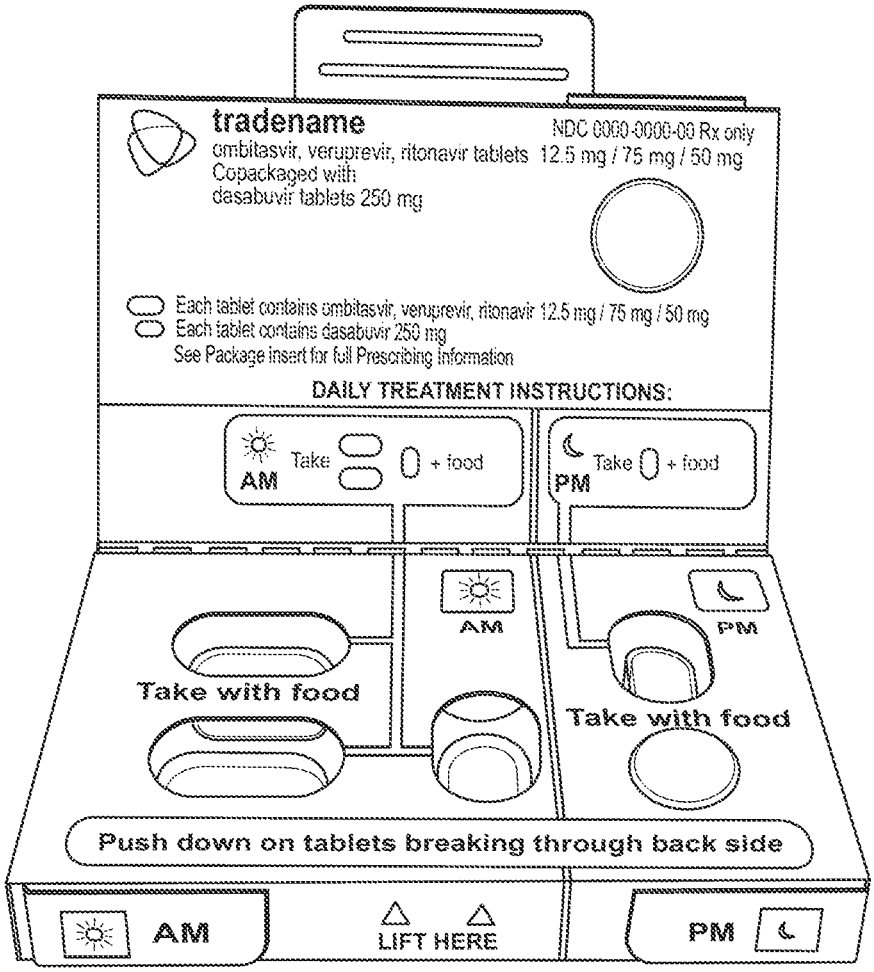
FIG. 3 is a front perspective view of a medicine container assembly in a first configuration according to another embodiment of the invention.
Figure 4:
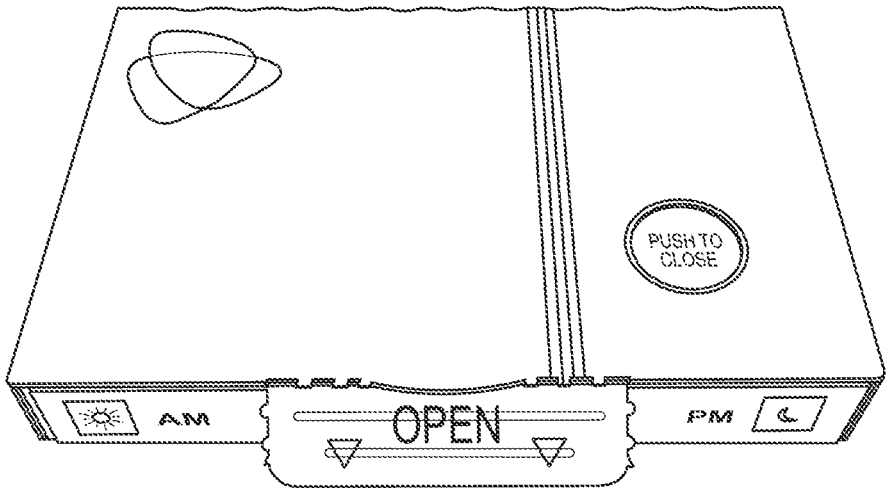
FIG. 4 is a front perspective view of the container illustrated in FIG. 3 in a second configuration.

With additional reference to FIGS. 1 and 3-4, the box 150 includes a plurality of walls that together define a cavity 154 therein. Specifically, the box 150 includes a first wall 158 spaced apart from and opposite a second wall 162. The first and second walls 158, 162 are spaced apart by intermediate walls 166. The first wall 158 includes a first side, which faces the cavity 154, and a second side, which faces an exterior of the box 150. The first wall 158 includes a plurality of openings 170 extending between the first and second sides and a protrusion 174 (FIG. 32) extending from the second side. The second wall 162 includes a first side, which faces the cavity 154, and a second side, which faces an exterior of the box 150. The second wall 158 includes a plurality of perforations 178.

FIGS. 33-37A,B illustrate a method of assembling the medication container assembly 10. In particular, the blister pack 20 and one of the pucks 100, 100*a-g* are configured to be received and secured within the box 150. The cavity 154 receives and secures the puck 100, 100*a-g* and blister pack 20 therein.

The following description is specific to pucks 100, 100*a*, 100*b*, however concepts are similar for pucks 100*c-g* where similar parts/components are noted but may have different numerals.

The blister pack 20 is coupled to the puck 100, 100*a*, 100*b* such that each of the plurality of compartments 40 is aligned with and protrudes through the corresponding plurality of openings 116 into the recess 112 of the puck 100. Glue may be applied to the blister pack to adhere the blister pack to the body 104, 104*a*, 104*b* of the puck 100, 100*a*, 100*b*. With the puck 100*b*, glue or other bonding material(s) is applied to the ribbed surfaces 130*b* at the ends of the walls 108*b*' to secure the puck 100*b* to the corresponding side walls of the box 150.

Figure 36A:
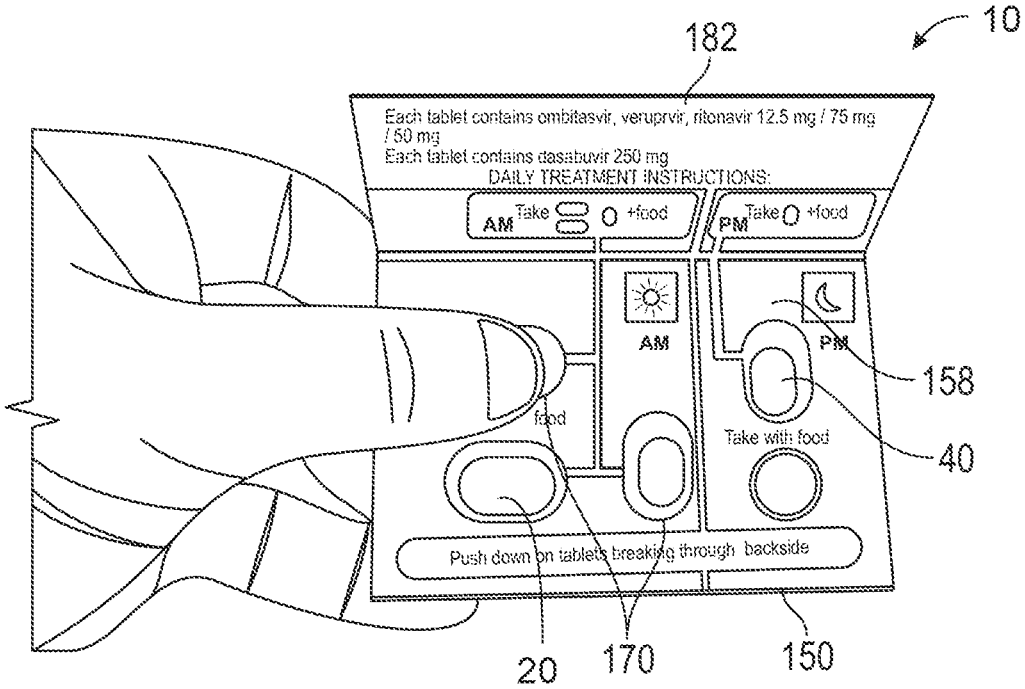
FIGS. 36A, 36B illustrate a method of use of the medicine container assembly of FIG. 33.
Figure 36B:
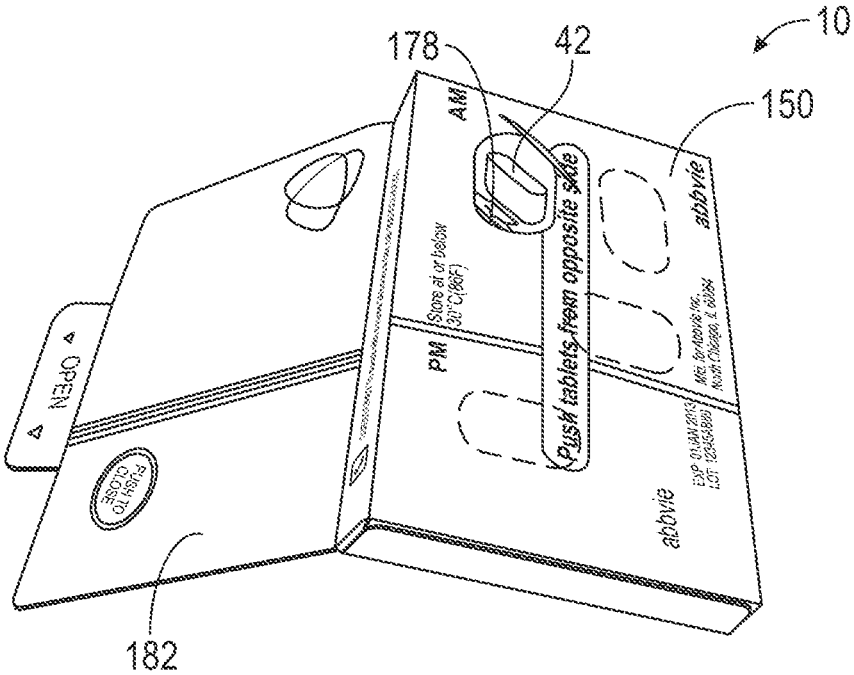
Figure 37A:
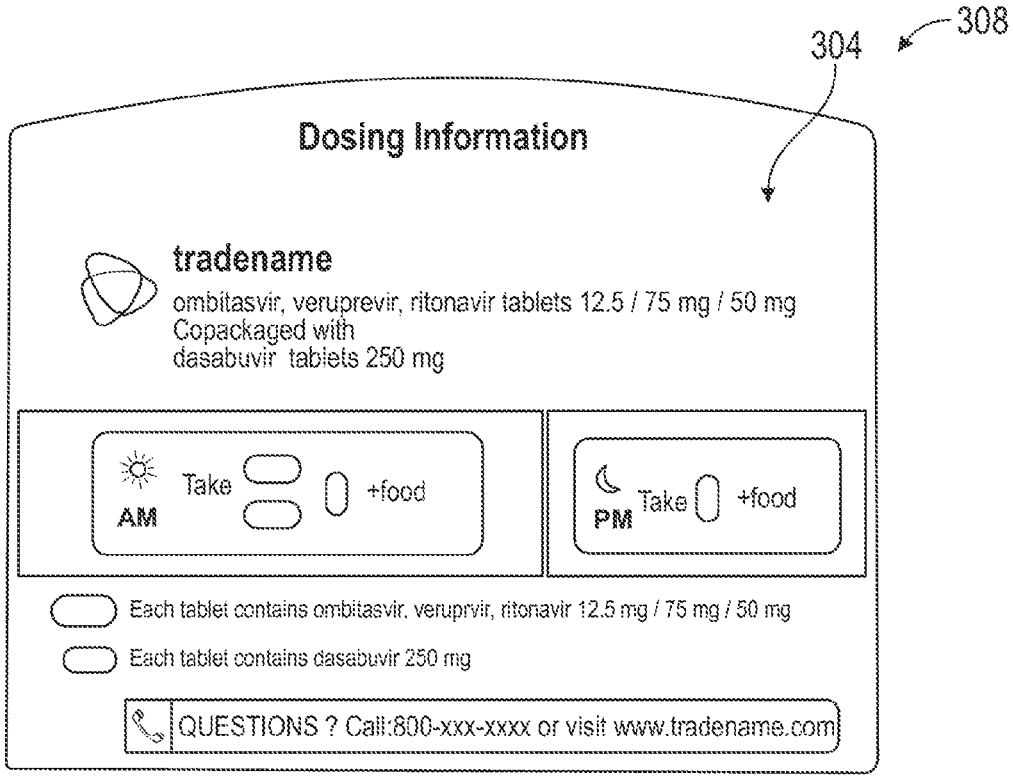
FIGS. 37A, 37B illustrate exemplary user instructions indicating the method of use of the medicine container assembly of FIGS. 36A, 36B.
Figure 37B:
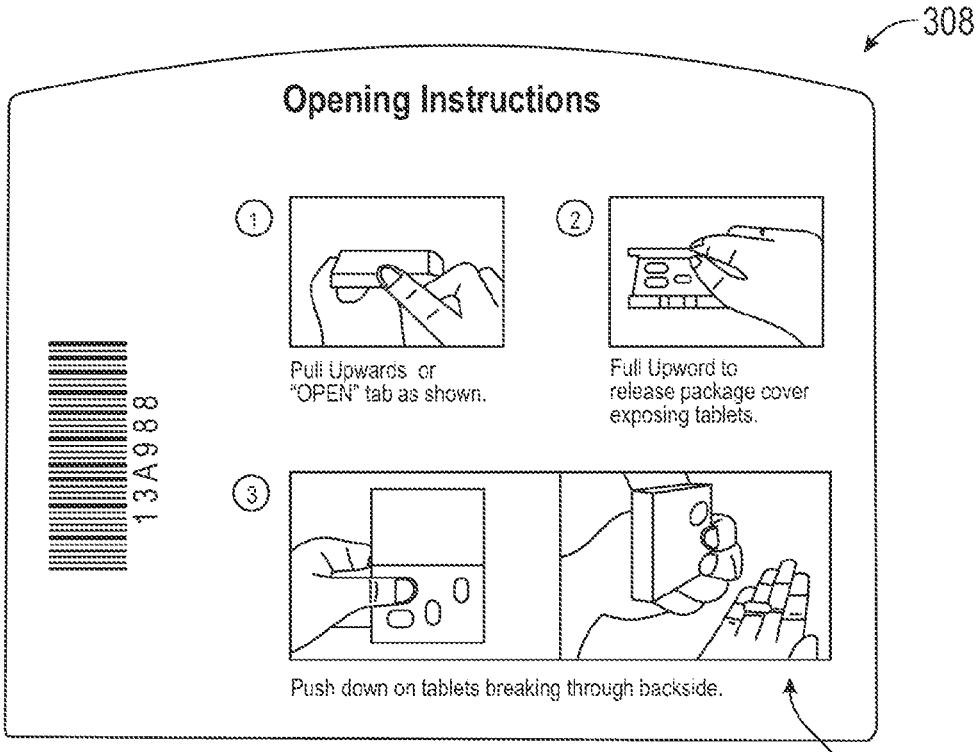

When secured within the cavity 154 of the box 150, the plurality of compartments 40 and plurality of openings 116, 116*a*, 116*b* in the puck 100, 100*a*, 100*b* are aligned with the plurality of openings 170 in the first wall 158 and plurality of perforations 178 in the second wall 162. As such, the medication 42 within the cavity 154 is viewable through the plurality of openings 170 in the first wall 158. Within the cavity 154, a gap (not shown) is created between the compartments 40 and the first wall 158 such that the compartments 40 are recessed relative to the first wall 158. Furthermore, the support knobs or ribs 50 of the blister pack 20 are not aligned with corresponding openings or perforations in the first and second walls. As such, the support knobs and ribs 50 maintain the gap or distance as medications 42 are expelled from the compartments 40 and the once medicine-filled compartments 40 are no longer able to retain their shape. A force applied through the plurality of openings 170 in the first wall to one or more of the compartments 40 causes the medication 42 to puncture the seal 54 in the blister pack 20 and severs the perforations 178 from the second wall 162. As such, the medication contained within one or more of the compartments 40 is expelled through the respective opening 116 in the puck 100 thereby creating holes in the second wall 162 of the box (FIGS. 36A-B). Instructions for use 300 and medication information 304 may be included on an instruction card 308 included in the packaging (FIGS. 37A-B).

Figure 38:
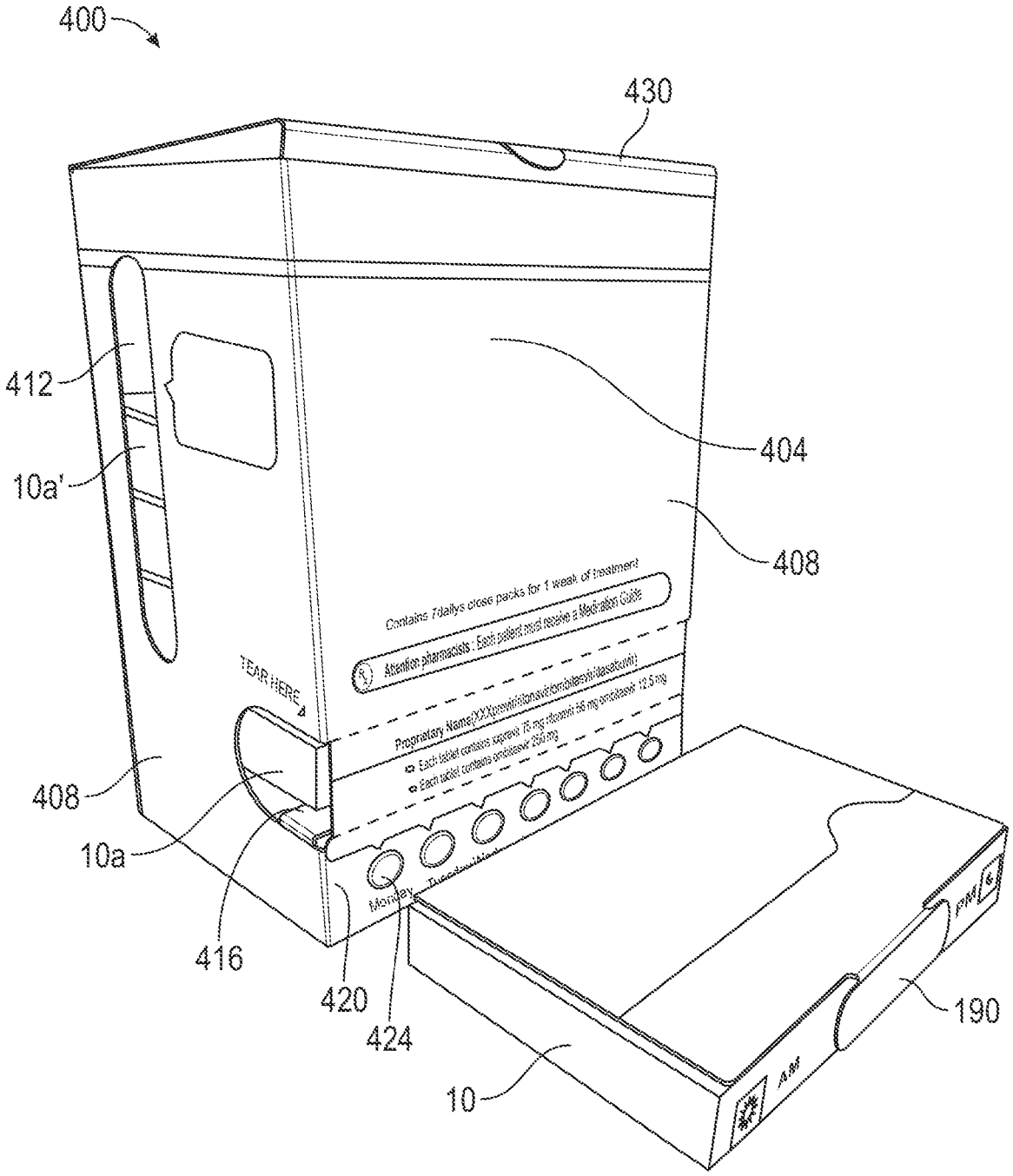
FIG. 38 is a front perspective view of a dispenser of a medicine container assembly.
Figure 39:
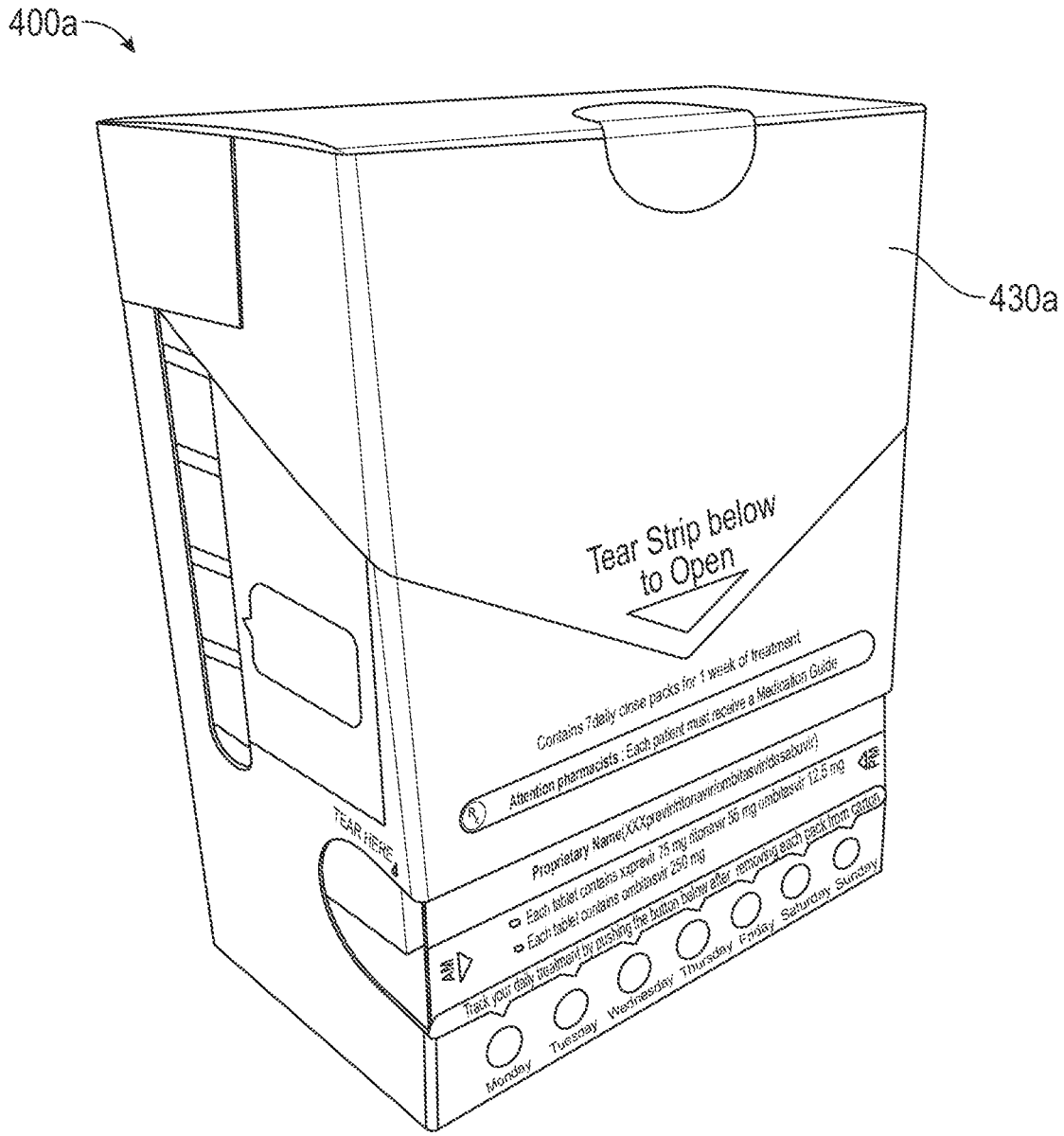
FIG. 39 is a front perspective view of a dispenser having another configuration.
Figure 40:
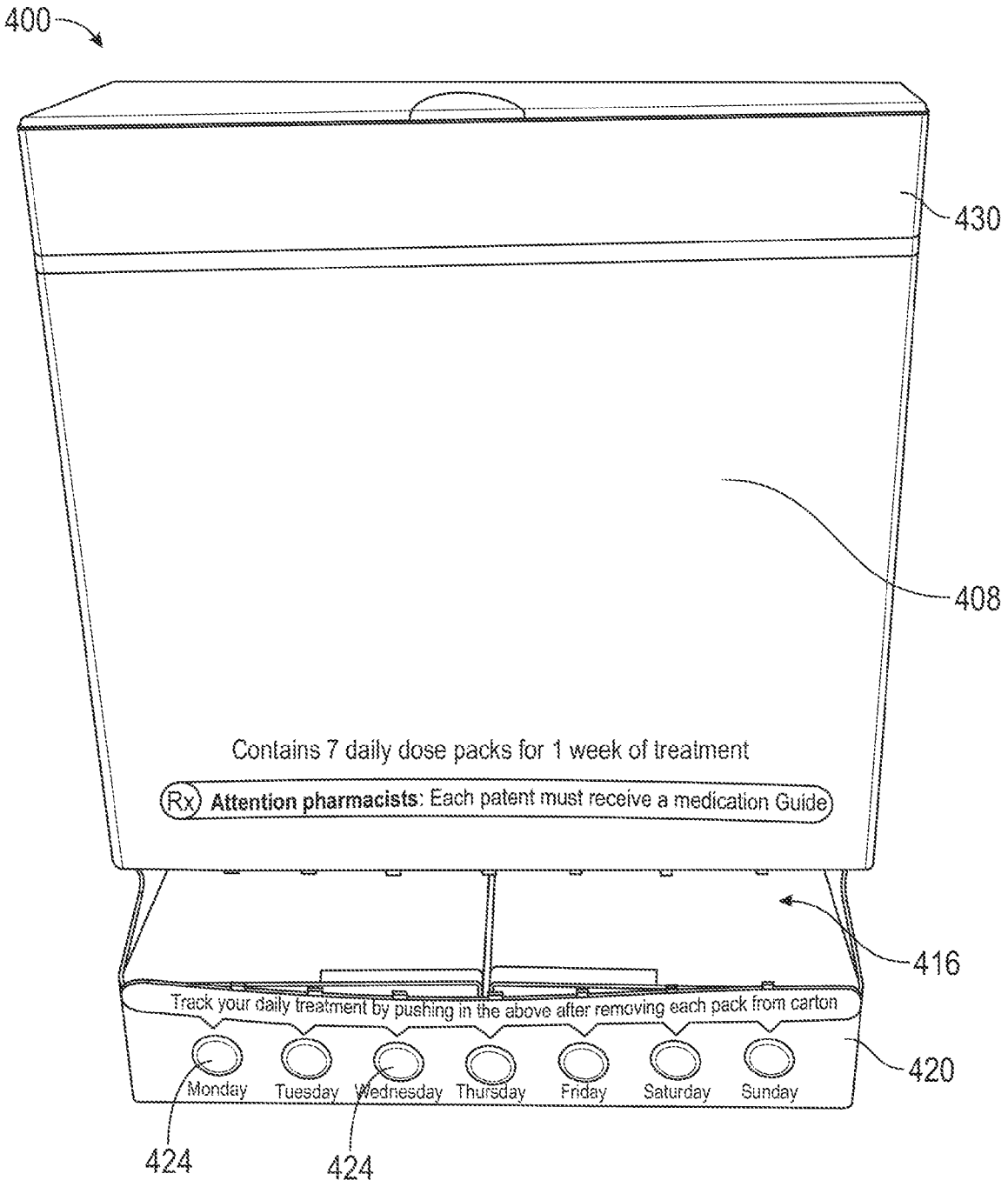
FIG. 40 is a front view of the dispenser illustrated in FIG. 39.
Figure 41A:
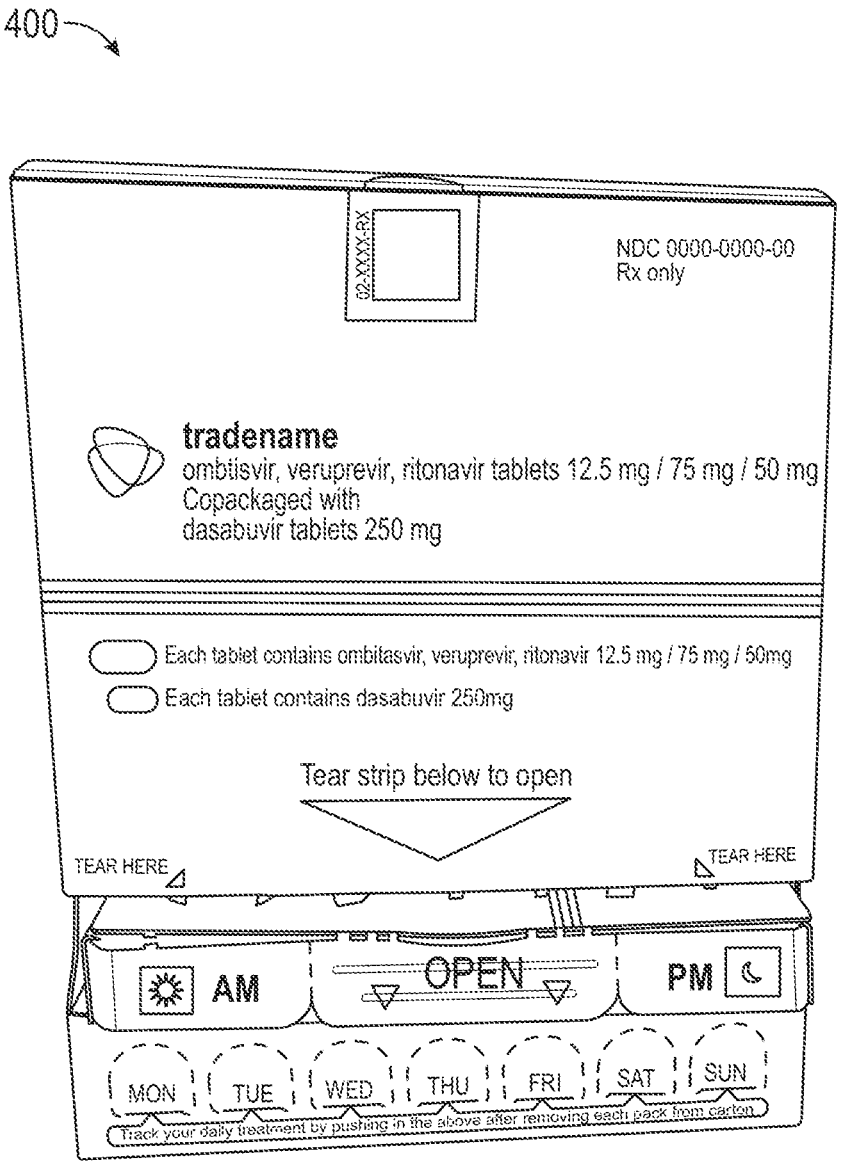
FIG. 41A is a front perspective view of a dispenser of a medicine container assembly illustrated in FIGS. 3-4.
Figure 41B:
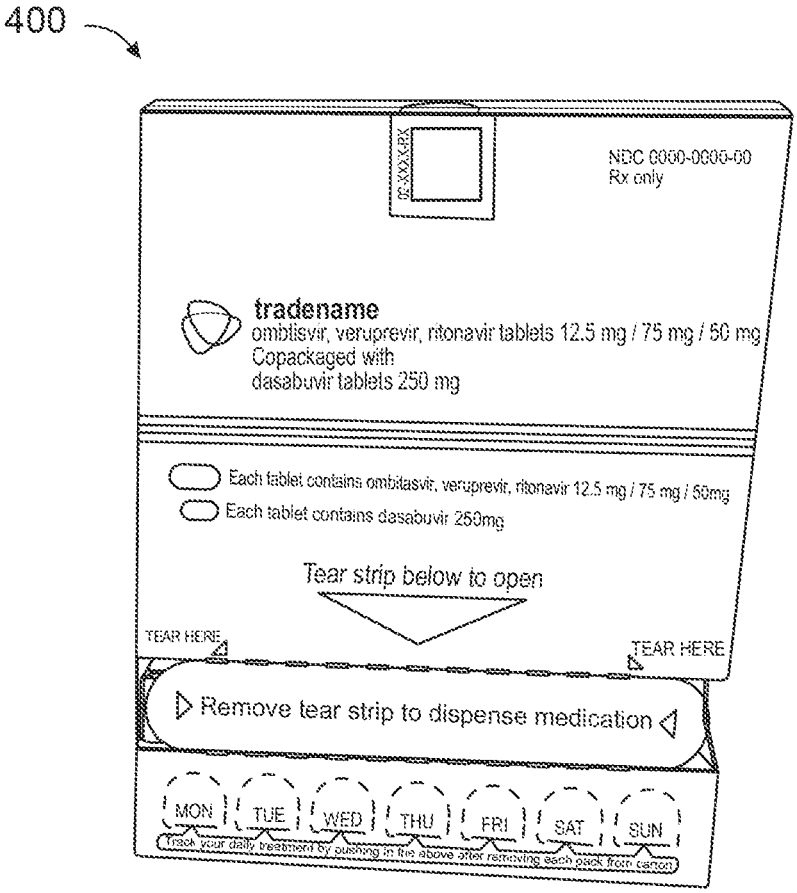
FIG. 41B is a front perspective view of the dispenser illustrated in FIG. 41A in an unopened configuration.
Figure 41C:
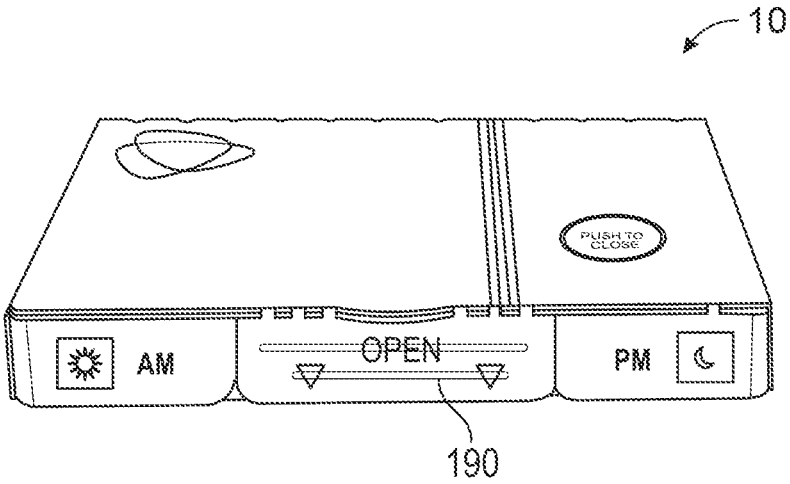
FIG. 41C is a front perspective view of the medicine container assembly illustrated in FIGS. 3-4.

A third wall or overlay 182 is hingedly coupled to the first wall 158 and/or one of the intermediate walls 166. The third wall 182 includes a first side, which includes medication information, and a second side. The first side of the third wall 182 includes an opening or recessed portion 186 that includes an adhesive configured to couple or removably adhered to the first wall 158. The third wall 182 includes a securement tab or seal 190 (FIGS. 4, 38). In a first closed position (FIGS. 4, 38), the securement tab 190 is secured to one of the intermediate walls 166 such that the cavity 154, and therefore the medication 42 contained within the blister pack 20 is inaccessible. In a second, open position, the securement tab 190 is released from the intermediate wall 166 thereby allowing the third wall 182 to pivot relative to the first wall 158. Once the securement tab 190 has been released, the cavity 154, and therefore the medication contained within the blister pack 20 is accessible. After the securement tab 190 has been released and medication 42 is dispensed, the opening 186 in the third wall 182, which includes an adhesive, may be removably adhered to the first side 158 to temporarily prevent access to the cavity 154 and medication 42 therein.

The box 150 may also include printed portions that provide instructions for administration of the medication contained therein. For example, in the embodiments illustrated and described herein, the box 150 may include regions or sections 194, 194' that correspond to regions in the blister pack 20. As such, a first region 194 of the box 150 may correspond to a first region (i.e., the first and second regions 60, 60' in FIGS. 5 and 6) while a second region 194' of the box 150 may correspond to a second region (i.e., the third region 60" in FIGS. 5 and 6) of the blister pack 20. The first region 194 of the box 150 is printed with corresponding instructions related to the medication in the first region. For example, the first region 194 includes instructions on when to take the medication and under what conditions the medication should be administered. Similarly, the second region 194' of the box 150 is printed with corresponding instructions related to the medication in the second region. For example, the second region 194' includes instructions on when to take the medication and under what conditions the medication should be administered. The instructions may also include a color code to more clearly delineate how the medication contained with the container is to be administered. For example, the first region 194 of the box 150 includes a first color (i.e., associated with morning or day time) while the second region 194' of the box 150 includes a second color (i.e., associated with evening or night time).

The medicine container assembly 10 includes several features that prevent a child from accessing the medication contained therein. First, at least the first wall 158 preferably includes a film overlay or laminate, which makes it more difficult for a child to tear or rip the container 10 at or near the openings 170. Additionally, the walls include a glue or other suitable adhesive that effectively couples the walls together, thus preventing a child from easily accessing the interior contents of the container 10. Further, the securement tab 190 is preferably a tamper-evident indicator tab. That is, releasing the securement tab 190 from the intermediate wall changes 166 the color (i.e., by removing a layer of paint or material or the like) of first and second indicator tabs 200. The color of the indicator tabs 200, which is different from the color of the surrounding wall 166, indicates to the user that the securement tab 190 has been initially removed. The securement tab 190 and indicator tabs 200 are advantageous because they alert the user that someone else has already tried to access the medication secured within the container 10. This feature is particularly advantageous to alert parents that a child may have had access to the medication. Another child-resistant feature of the container 10 is that once the third wall 182 has been released by the securement tab 190 and the cavity 154 and medication are accessible, the gap between the first wall 158 and plurality of compartments 40 increase the distance and force necessary to break the seal 54 in the blister pack 20 and sever the perforations 178. The force necessary to dispense the medication is further increased by the puck 100, which introduces added stiffness and rigidity to the assembled container 10. The medication container 10 is thus constructed to prevent children from accessing the medication secured therein and to meet regulatory standards for child-resistant packaging.

The medicine container 10 is assembled using one or more of the following steps. First, the box 150 is prepared and folded. As illustrated in FIG. 32, prior to being assembled, the box blank includes a first side and a second side. The box blank further includes a first section 250, a second section 254 and a third section 258, which are arranged linearly. The first section 250 includes first, second, and third projections 260*a*-260*c*, the second section 254 includes fourth and fifth projections 262*a*, 262*b*, and the third section 258 includes the securement tab 190 and a label portion 270 coupled thereto. A first intermediate section 280 is disposed between the first and second sections 250, 254 and a second intermediate section 284 is disposed between the second and third sections 254, 258. The first intermediate section 280 includes the indicator tabs 200. The first section 250 includes the plurality of openings 170 extending between the first and second sides, indicated by the solid lines, while the second section 254 includes the plurality of perforations 178, indicated by the dashed lines.

The box blank is assembled by bending the first section 250 along a point of connection between the first section 250 and the first intermediate section 280. Similarly, the second section 254 is bent along a point of connection between the first intermediate section 280 and the second section 254. In doing so, the first section 250, which forms the first wall 158, is spaced apart from the second section 254, which forms the second wall 162, by the first intermediate section 280, which is one of the intermediate walls 166. The third projection 260*c* extending from the first section 250 is then secured (i.e., by adhesive or the like) to the second intermediate section 284. The first and second intermediate sections 280, 284 are therefore two of the intermediate walls 166 between the first and second walls 158, 162 of the box blank. When coupled by the intermediate walls 166, the first and second walls 158, 162 are parallel to one another such that the plurality of openings 170 in the first wall 158 are aligned with the plurality of perforations 178 in the second wall 162. The plurality of openings 170 are also complementary to the plurality of perforations 178. The first and second walls 158, 162 also define a portion of the cavity 154 when coupled by two of the four intermediate walls 166.

Prior to being inserted in the cavity 154, the blister pack 20 is applied to the puck such that each of the plurality of compartments of the blister pack 20 is aligned with the plurality of openings 116 in the puck 100. As discussed above, each of the plurality of openings 116 is configured to be complementary to one of the plurality of compartments. Then, together, the blister pack 20 and puck 100 are inserted into the box 150 between the first and second walls 158, 162. The plurality of openings 170 extending through the first wall 158 of the box 150 are aligned with the plurality of perforations 178 in the second wall 162. Each of the plurality of openings 116 of the puck 100 align with the plurality of openings 170 in the first wall 158 and plurality of perforations 178 in the second wall 162. Furthermore, like the openings 116 in the puck 100, each of the aligned plurality of openings 170 in the first wall 158 and plurality of perforations 176 in the second wall 162 are complementary to and aligned with one of the plurality of compartments 40. As such, the medication 42 within the cavity 154 is viewable through the plurality of openings 170 in the first wall 158.

The medicine container assembly 10 is assembled by securing the blister pack 20 and puck 100 within the cavity 154 of the box 150 such that the medication in each of the plurality of compartments 40 is viewable through the plurality of openings 170 in the first wall 158. Accordingly, auxiliary tabs 304 extending from each of the first and second intermediate sections 280, 284 and the first and second projections 260*a*, 262*a*, 260*b*, 260*b* extending from each of the first and second sections 250, 254 (e.g., first and second walls 158, 162) are folded. As such, the first projections 260, 262*a* overlap and are secured to the second projections 260*b*, 262*b*, which overlap and are secured to the auxiliary projections 304. The walls of the box blank are secured by glue or another suitable adhesive.

Figure 42:
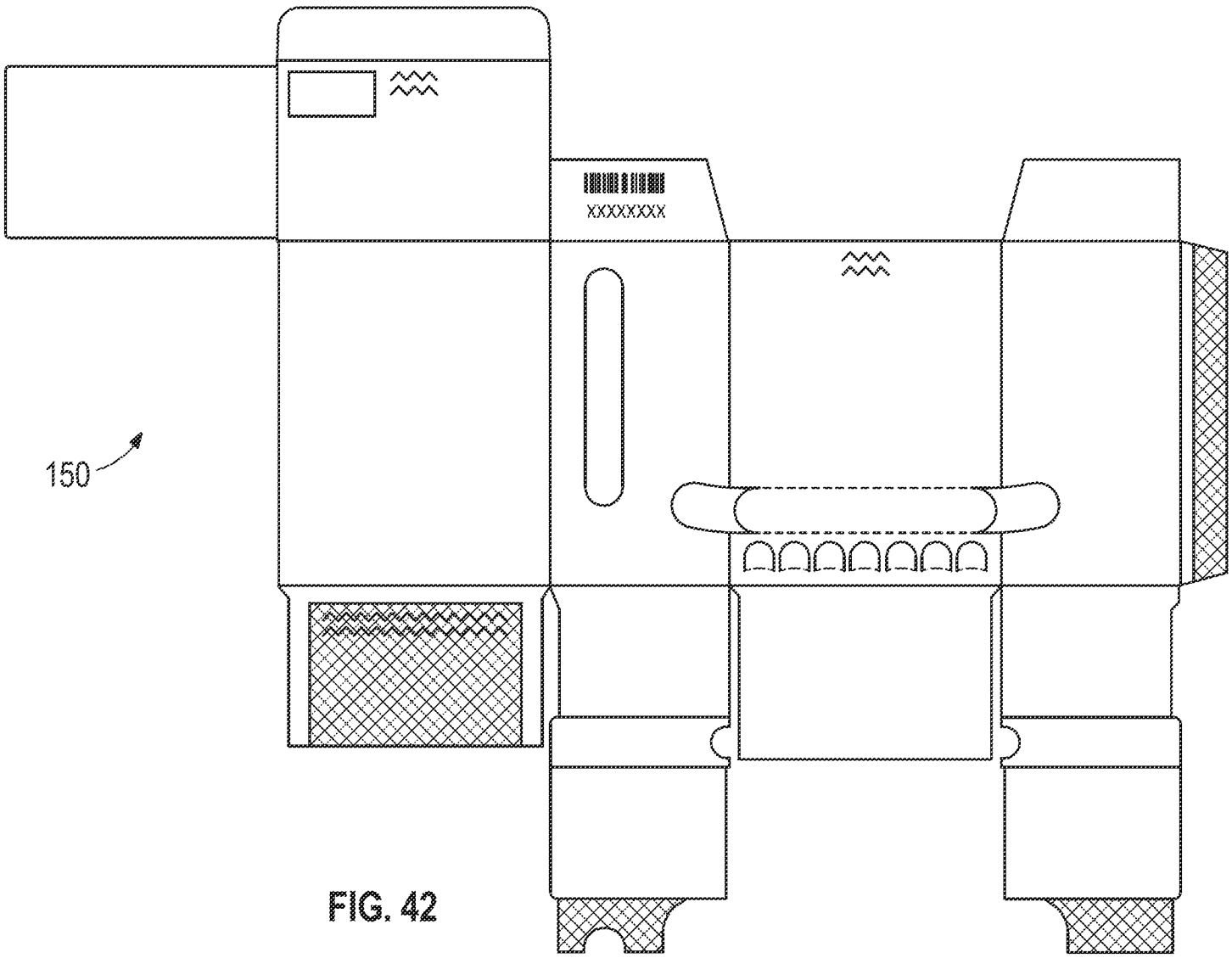
FIG. 42 is illustrates an exemplary box blank of the dispenser.

The medication information, which might include instructions, dosing information, or information about the medication, is coupled (e.g., by an adhesive) to the first side of the third wall 182. The third wall 182 is then such that the third wall 182 overlays the first wall 158. The securement tab 190 is then coupled to one of the intermediate walls 166 to complete the assembly of the container 10. In the embodiments illustrated in FIGS. 1-37A,B, the blister packs 20, 20*a*, 20*b*, the pucks 100, 100*a*-*g*, and the box 150 are configured to receive and secure a daily dose of medication. However, in additional or alternative embodiments, the blister packs, the pucks, and the box may be configured to receive and secure hourly, weekly, or monthly medication doses. For example, the box 150' of FIG. 42, when assembled, is configured to receive and secure a blister pack and puck that receive and secure a weekly dose of medication. As illustrated in FIG. 42, the concepts discussed herein are similar except that the aperture/perforation configuration accommodates a different number and size of medication/pill.

The medicine container assembly 10 may be used to dispense appropriate doses of medication secured therein according to one or more of the following steps. First, the securement tab 190 is released such that the third wall 182 moves from a first, closed position (FIGS. 4, 38, 41A-C) in which the third wall 182 overlays the first wall 158 to a second, open position (FIGS. 1, 3) in which the first wall 158 and the cavity 154 of the box 150 are accessible. Upon the release of the securement tab 190, the indicator tabs 166 turn to a color that is different than the color of the surrounding wall. In the open position, instructions for appropriate administration of the medication are clearly visible. One or more doses of medication contained in the respective one or more of the plurality of compartments 40 of the blister pack 20 is expelled by applying a substantial force through the corresponding complementary opening 170 in the first wall 158 to a surface of the compartment 40. The force causes the medication secured within the compartment 40 to puncture the seal 54 in the second side 26 of the blister pack 20 thereby moving the medication or pill through the opening 48 of the compartment 40. The force continues to move the medication through the corresponding complementary opening 116 in the puck 100 such that the force of the medication against the corresponding complementary perforation 178 causes the perforation 178 to sever from the surrounding second wall 162. Therefore, a hole in the second wall 162 is created as the medication is expelled from the container 10. Once the medication has been dispensed, the third wall 182 may be moved from the second, open position to a third resealed position (not shown). Once again, access to the cavity 154, and therefore the medication contained therein, is inaccessible. Therefore, the plurality of openings 170 in both the first wall 158 of the box 150 and the puck 100 and the plurality of perforations 178 in the second wall 162 of the box 150 are all complementary and configured to be aligned.

As illustrated in FIGS. 38-39, 41A-C one or more of the child-resistant medicine container assemblies 10 may be housed in and dispensed from a gravity-feed dispenser 400. The gravity-feed dispenser 400 has a first side, second side, front side, back side, a top side and a bottom side. The dispenser 400 further includes a substantially rectangular body 404 defined by six walls 408, which enclose a substantially rectangular cavity 412. An aperture or opening 416 sized and shaped to receive one child-resistant medication container 10 extends along a bottom of a front wall of the dispenser 400 and between a first side wall and a second, opposite side wall of the container 10. The aperture 416 is spaced apart from a bottom wall by a gap or platform 420, which includes a plurality of protrusions 424. A non-removable lid 430 is coupled to the top side of the dispenser 400. Once the one or more containers 10 are stacked within the cavity 412, the lid 430 is irremovably sealed to the body 404 of the dispenser 400 such that the containers 10 cannot be removed through the top of the dispenser 400. A bottom container 10*a* is disposed within the aperture 416, and the other containers 10*a*' are stacked on top of the bottom container 10*a* within the cavity 412. The bottom container 10*a* may be removed from the dispenser 400 by grasping the container 10*a* through the openings created by the aperture 416 in the first and second side walls.

Once the bottom container 10*a* is removed, an adjacent container 10*a*', and therefore all of the other containers 10*a*' move downward. The adjacent container 10*a*' becomes the bottom container 10*a* and is disposed within the aperture 416 and is ready to be removed. Once a container 10*a* is removed, one of the protrusions 424 may be depressed to indicate that container 10*a* has been removed. For example, the dispenser in the illustrated embodiment is sized and shaped to house seven containers 10 (e.g., a one week's worth of the medication) and the gap includes seven protrusions, one for each day of the week. On a first day of the week (e.g., Monday), the first, bottom container 10 is removed and the first protrusion is depressed. Therefore, the user is alerted to the fact that there should be six containers remaining in the dispenser, which is evident by the through hole in at least one of the first and second side walls or the rear wall and by the six remaining un-depressed protrusions. The dispenser is considered a child-resistant feature because the intended user can modify the amount of containers that are housed in the dispenser compared to the amount of containers that should be in the dispenser.

Thus, the invention provides, among other things, a child-resistant medication container. The invention additionally provides a method of assembling the child-resistant medication container. The invention further provides a method of dispensing medication from a child-resistant medication container. The invention also provides a dispenser for dispensing a plurality of child-resistant medication containers.

Various features and advantages of the invention are set forth in the following claims.

What is claimed is:

1. A child-resistant medication container assembly comprising:

a blister pack including a plurality of compartments, each of the plurality of compartments configured to support at least one medication;

a puck including a recess having a plurality of openings with each opening in the puck corresponding to one of the plurality of compartments of the blister pack; and a box including a first wall opposite a second wall, a plurality of openings extending through the first wall, each of the openings in the first wall being aligned with corresponding perforations in the second wall, each of the openings in the first wall being aligned with one of the openings in the puck and a corresponding compartment of the blister pack.

2. The child-resistant medication container of claim 1 wherein each of the plurality of compartments is spaced apart from the complementary opening in the box.

3. The child-resistant medication container of claim 1 wherein the box includes a series of instructions for administering the medication secured within the plurality of compartments of the blister pack.

4. The child resistant medication container of claim 1 wherein the blister pack further includes a first region and a second region, each of the first and second regions including at least one of the plurality of compartments.

5. The child resistant medication container of claim 4 wherein the box further includes a first region and a second region, each of the first and second regions including at least one of the plurality of openings.

6. The child resistant medication container of claim 5 wherein the first region of the blister pack is aligned with the first region of the box, and the second region of the blister pack is aligned with the second region of the box.

7. The child resistant medication container of claim 5 wherein the first region of the box includes a first set of instructions for administering the medication secured in the at least one of the plurality of compartments of the first region and wherein the second region of the box includes a second set of instructions for administering the medication secured in the at least one of the plurality of compartments of the second region.

8. The child resistant medication container of claim 1 wherein the box is constructed from cardboard having a layer of tear-resistant film.

9. The child resistant medication container of claim 1 wherein the puck further includes a plurality of openings extending through the recess, each of the plurality of openings configured to be complementary to and in alignment with one of the plurality of compartments.

10. The child resistant medication container of claim 1 wherein the puck includes a height that is greater than a height of one of the compartments of the blister pack.

11. The child resistant medication container of claim 1 wherein the puck is constructed from molded paper pulp and bamboo fiber.

12. The child resistant medication container of claim 1 wherein the medication secured in each of the plurality of compartments is accessible by puncturing a seal in the blister pack.

13. The child resistant medication container of claim 1 wherein the box is assembled and secured by glued-end construction.

14. The child resistant medication container of claim 1 wherein the box includes a third wall hingedly coupled to the first wall, the third wall overlaying the first wall to prevent access to the plurality of openings in the box.

15. A method of assembling a child-resistant medication container, the method comprising:

aligning a blister pack including a plurality of compartments with a puck including a recess and a plurality of openings, each of the plurality of openings configured to be complementary to one of the plurality of compartments;

attaching the blister pack to the puck;

inserting the blister pack and the puck into a box, the box including a first wall opposite a second wall, a plurality of openings extending through the first wall and being aligned with a plurality of perforations in the second wall, each of the aligned plurality of openings and perforations being complementary to one of the plurality of compartments; and closing the box to enclose the blister pack and the puck.

16. The method of assembling a child-resistant medication container of claim 15 wherein inserting the blister pack and puck into the box includes maintaining a gap between the plurality of compartments and the plurality of openings in the first wall.

17. The method of assembling a child-resistant medication container of claim 15 wherein securing the blister pack and the puck within the box includes overlaying and securing a third wall over the first wall.

18. The method of assembling a child-resistant medication container of claim 15, further comprising printing on the box a series of instructions for administering the medication secured within the plurality of compartments.

19. The method of assembling a child-resistant medication container of claim 15 further comprising:

providing the blister pack with a first region and a second region, each of the first and second regions including at least one of the plurality of compartments;

providing the box with a first region and a second region, each of the first and second regions including at least one of the plurality of openings;

aligning the first region of the blister pack with the first region of the box;

aligning the second region of the blister pack with the second region of the blister pack;

printing on the first region of the box a first instruction for administering the medication secured within the at least one of the plurality of compartments of the first region; and printing on the second region of the box a second instruction for administering the medication secured within the at least one of the plurality of compartments of the second region.

20. A method of dispensing medication secured within a child-resistant medication container to a user, the method comprising:

providing a container including a box, a puck, and a blister pack, the puck being secured to the box, and the blister pack being secured to the puck;

applying a force to at least one compartment of a plurality of compartments of the blister pack, each of the plurality of compartments being aligned with a complementary one of a plurality of openings in a first wall of the box;

breaking a seal of the at least one compartment to move medication contained within the at least one compartment;

expelling the medication through an opening in the recess of the puck, the opening being complementary to the at least one compartment; and expelling the medication through a perforation in a second wall of the box, the perforation being complementary to the at least one compartment.

* * * * *